US009301567B2

(12) United States Patent
Dealey et al.

(10) Patent No.: US 9,301,567 B2
(45) Date of Patent: Apr. 5, 2016

(54) ARTICLE OF FOOTWEAR INCORPORATING A KNITTED COMPONENT WITH MONOFILAMENT AREAS

(71) Applicant: NIKE, Inc., Beaverton, OR (US)

(72) Inventors: Stuart W. Dealey, Portland, OR (US); David J. Roulo, Portland, OR (US); Nadia M. Panian, Portland, OR (US); Jeffrey C. Spanks, Portland, OR (US); Roberto Zavala, Portland, OR (US)

(73) Assignee: Nike, Inc., Beaverton, OR (US)

( * ) Notice: Subject to any disclaimer, the term of this patent is extended or adjusted under 35 U.S.C. 154(b) by 0 days.

(21) Appl. No.: 14/535,554

(22) Filed: Nov. 7, 2014

(65) Prior Publication Data

US 2016/0058100 A1 Mar. 3, 2016

Related U.S. Application Data

(60) Provisional application No. 62/043,450, filed on Aug. 29, 2014.

(51) Int. Cl.

| | |
|---|---|
| ***A43B 1/04*** | (2006.01) |
| ***A43B 23/02*** | (2006.01) |
| ***D04B 1/14*** | (2006.01) |
| ***D04B 1/22*** | (2006.01) |

(52) U.S. Cl.

CPC ..... *A43B 1/04* (2013.01); *A43B 23/0245* (2013.01); *D04B 1/14* (2013.01); *D04B 1/22* (2013.01); *D10B 2401/061* (2013.01); *D10B 2501/043* (2013.01)

(58) Field of Classification Search

CPC ..... A43B 1/04; A43B 23/0245; D04B 1/14; D04B 1/22

USPC ..... 66/169 R, 170, 171, 177; 36/45–48

See application file for complete search history.

(56) References Cited

U.S. PATENT DOCUMENTS

| | | | |
|---|---|---|---|
| 601,192 | A | 3/1898 | Woodside |
| 1,215,198 | A | 2/1917 | Rothstein |
| 1,597,934 | A | 8/1926 | Stimpson |
| 1,888,172 | A | 11/1932 | Joha |

(Continued)

FOREIGN PATENT DOCUMENTS

| | | |
|---|---|---|
| DE | 870963 C | 3/1953 |
| DE | 1084173 | 6/1960 |

(Continued)

OTHER PUBLICATIONS

Declaration of Dr. Edward C. Frederick from the US Patent and Trademark Office Inter Partes Review of U.S. Pat. No. 7,347,011 (178 pp).

(Continued)

*Primary Examiner* — Danny Worrell

(74) *Attorney, Agent, or Firm* — Brinks Gilson & Lione

(57) ABSTRACT

An article of footwear includes an upper incorporating a knitted component formed of unitary knit construction. The knitted component includes areas formed using monofilament strands. The monofilament areas may be bounded by multifilament areas. The multifilament areas may be configured to form a welt that includes a tensile element.

18 Claims, 14 Drawing Sheets

(56) References Cited

U.S. PATENT DOCUMENTS

| | | | | |
|---|---|---|---|---|
| 1,902,780 | A | 3/1933 | Holden et al. | |
| 1,910,251 | A | 5/1933 | Joha | |
| 2,001,293 | A | 5/1935 | Wilson | |
| 2,047,724 | A | 7/1936 | Zuckerman | |
| 2,147,197 | A | 2/1939 | Glidden | |
| 2,151,879 | A * | 3/1939 | Weber | D04B 1/18 66/190 |
| 2,314,098 | A | 3/1943 | McDonald | |
| 2,330,199 | A | 9/1943 | Basch | |
| 2,343,390 | A | 3/1944 | Ushakoff | |
| 2,400,692 | A | 5/1946 | Herbert | |
| 2,440,393 | A | 4/1948 | Clark | |
| 2,569,764 | A | 10/1951 | Jonas | |
| 2,586,045 | A | 2/1952 | Hoza | |
| 2,608,078 | A | 8/1952 | Anderson | |
| 2,641,004 | A | 6/1953 | Whiting et al. | |
| 2,675,631 | A | 4/1954 | Doughty | |
| 2,994,322 | A | 8/1961 | Cullen et al. | |
| 3,583,081 | A | 6/1971 | Hayashi | |
| 3,694,940 | A | 10/1972 | Stohr | |
| 3,704,474 | A | 12/1972 | Winkler | |
| 3,766,566 | A | 10/1973 | Tadakoro | |
| 3,778,856 | A | 12/1973 | Christie et al. | |
| 3,952,427 | A | 4/1976 | Von den Benken et al. | |
| 3,972,086 | A | 8/1976 | Belli et al. | |
| 4,027,402 | A | 6/1977 | Liu et al. | |
| 4,031,586 | A | 6/1977 | Von den Benken et al. | |
| 4,211,806 | A | 7/1980 | Civardi et al. | |
| 4,232,458 | A | 11/1980 | Bartels | |
| 4,255,949 | A | 3/1981 | Thorneburg | |
| 4,258,480 | A | 3/1981 | Famolare, Jr. | |
| 4,317,292 | A | 3/1982 | Melton | |
| 4,373,361 | A | 2/1983 | Thorneburg | |
| 4,447,967 | A | 5/1984 | Zaino | |
| 4,465,448 | A | 8/1984 | Aldridge | |
| 4,607,439 | A | 8/1986 | Sogabe et al. | |
| 4,737,396 | A | 4/1988 | Kamat | |
| 4,750,339 | A | 6/1988 | Simpson et al. | |
| 4,756,098 | A | 7/1988 | Boggia | |
| 4,785,558 | A | 11/1988 | Shiomura | |
| 4,813,158 | A | 3/1989 | Brown | |
| 5,031,423 | A | 7/1991 | Ikenaga | |
| 5,095,720 | A | 3/1992 | Tibbals, Jr. | |
| 5,117,567 | A | 6/1992 | Berger | |
| 5,152,025 | A | 10/1992 | Hirmas | |
| 5,192,601 | A | 3/1993 | Neisler | |
| 5,345,638 | A | 9/1994 | Nishida | |
| 5,353,524 | A | 10/1994 | Brier | |
| 5,371,957 | A | 12/1994 | Gaudio | |
| 5,461,884 | A | 10/1995 | McCartney et al. | |
| 5,511,323 | A | 4/1996 | Dahlgren | |
| 5,572,860 | A | 11/1996 | Mitsumoto et al. | |
| 5,575,090 | A | 11/1996 | Condini | |
| 5,623,840 | A | 4/1997 | Roell | |
| 5,729,918 | A | 3/1998 | Smets | |
| 5,735,145 | A | 4/1998 | Pernick | |
| 5,746,013 | A | 5/1998 | Fay, Sr. | |
| 5,765,296 | A | 6/1998 | Ludemann et al. | |
| 5,884,419 | A | 3/1999 | Davidowitz et al. | |
| 5,996,189 | A | 12/1999 | Wang | |
| 6,029,376 | A | 2/2000 | Cass | |
| 6,032,387 | A | 3/2000 | Johnson | |
| 6,052,921 | A | 4/2000 | Oreck | |
| 6,088,936 | A | 7/2000 | Bahl | |
| 6,151,802 | A | 11/2000 | Reynolds | |
| 6,170,175 | B1 | 1/2001 | Funk | |
| 6,308,438 | B1 | 10/2001 | Throneburg et al. | |
| 6,333,105 | B1 | 12/2001 | Tanaka et al. | |
| 6,401,364 | B1 | 6/2002 | Burt | |
| 6,558,784 | B1 | 5/2003 | Norton et al. | |
| 6,588,237 | B2 | 7/2003 | Cole et al. | |
| 6,754,983 | B2 | 6/2004 | Hatfield et al. | |
| 6,910,288 | B2 | 6/2005 | Dua | |
| 6,922,917 | B2 | 8/2005 | Kerns et al. | |
| 6,931,762 | B1 | 8/2005 | Dua | |
| D517,297 | S | 3/2006 | Jones et al. | |
| 7,051,460 | B2 | 5/2006 | Orei et al. | |
| 7,056,402 | B2 | 6/2006 | Koerwien et al. | |
| 7,347,011 | B2 | 3/2008 | Dua et al. | |
| 7,441,348 | B1 | 10/2008 | Dawson | |
| 7,543,397 | B2 | 6/2009 | Kilgore et al. | |
| 7,568,298 | B2 | 8/2009 | Kerns | |
| 7,682,219 | B2 | 3/2010 | Falla | |
| 7,774,956 | B2 * | 8/2010 | Dua | A43B 1/04 36/45 |
| 8,490,299 | B2 | 7/2013 | Dua et al. | |
| 8,631,589 | B2 * | 1/2014 | Dojan | A43B 23/0275 36/45 |
| 9,027,260 | B2 * | 5/2015 | Dua | A43B 1/04 36/45 |
| 2002/0078599 | A1 | 6/2002 | Delgorgue et al. | |
| 2002/0148258 | A1 | 10/2002 | Cole et al. | |
| 2003/0126762 | A1 | 7/2003 | Tseng | |
| 2003/0191427 | A1 | 10/2003 | Jay et al. | |
| 2004/0118018 | A1 | 6/2004 | Dua | |
| 2004/0181972 | A1 | 9/2004 | Csorba | |
| 2005/0115284 | A1 | 6/2005 | Dua | |
| 2005/0193592 | A1 | 9/2005 | Dua et al. | |
| 2005/0273988 | A1 | 12/2005 | Christy | |
| 2005/0284000 | A1 | 12/2005 | Kerns | |
| 2006/0059715 | A1 | 3/2006 | Aveni | |
| 2006/0162187 | A1 | 7/2006 | Byrnes et al. | |
| 2007/0022627 | A1 | 2/2007 | Sokolowski et al. | |
| 2007/0180730 | A1 | 8/2007 | Greene et al. | |
| 2007/0294920 | A1 | 12/2007 | Baychar | |
| 2008/0017294 | A1 | 1/2008 | Bailey et al. | |
| 2008/0078102 | A1 | 4/2008 | Kilgore et al. | |
| 2008/0110048 | A1 | 5/2008 | Dua et al. | |
| 2008/0110049 | A1 * | 5/2008 | Sokolowski | A43B 3/0031 36/50.1 |
| 2008/0189830 | A1 | 8/2008 | Egglesfield | |
| 2008/0313939 | A1 | 12/2008 | Ardill | |
| 2009/0068908 | A1 | 3/2009 | Hinchcliff | |
| 2010/0051132 | A1 | 3/2010 | Glenn | |
| 2010/0154256 | A1 | 6/2010 | Dua | |
| 2010/0170651 | A1 | 7/2010 | Scherb et al. | |
| 2010/0175276 | A1 * | 7/2010 | Dojan | A43B 3/26 36/47 |
| 2010/0251491 | A1 * | 10/2010 | Dojan | A43B 23/0225 12/142 R |
| 2010/0251564 | A1 * | 10/2010 | Meschter | A43B 23/0225 36/28 |
| 2011/0030244 | A1 | 2/2011 | Motawi et al. | |
| 2011/0041359 | A1 * | 2/2011 | Dojan | A43B 23/0265 36/47 |
| 2011/0078921 | A1 | 4/2011 | Greene et al. | |
| 2012/0233882 | A1 | 9/2012 | Huffa et al. | |
| 2012/0255201 | A1 | 10/2012 | Little | |

FOREIGN PATENT DOCUMENTS

| | | | |
|---|---|---|---|
| DE | 19738433 | | 4/1998 |
| DE | 19728848 | | 1/1999 |
| EP | 0279950 | A2 | 8/1988 |
| EP | 0448714 | | 10/1991 |
| EP | 0728860 | | 8/1996 |
| EP | 0758693 | | 2/1997 |
| EP | 0898002 | A2 | 2/1999 |
| EP | 1233091 | | 8/2002 |
| EP | 1437057 | A1 | 7/2004 |
| EP | 1563752 | A1 | 8/2005 |
| EP | 1602762 | A1 | 12/2005 |
| EP | 1972706 | A1 | 9/2008 |
| FR | 2171172 | | 9/1973 |
| GB | 538865 | | 8/1941 |
| GB | 2018837 | A | 10/1979 |
| GB | 1603487 | | 11/1981 |
| JP | H06113905 | | 4/1994 |
| JP | H08109553 | | 4/1996 |
| JP | H11302943 | | 11/1999 |
| NL | 7304678 | | 10/1974 |

(56) References Cited

FOREIGN PATENT DOCUMENTS

| | | |
|---|---|---|
| WO | 9003744 | 4/1990 |
| WO | 0032861 | 6/2000 |
| WO | 0231247 | 4/2002 |

OTHER PUBLICATIONS

David J. Spencer, Knitting Technology: A Comprehensive Handbook and Practical Guide (Third ed., Woodhead Publishing Ltd. 2001) (413 pp).

Excerpt of Hannelore Eberle et al., Clothing Technology (Third English ed., Beuth-Verlag GmnH 2002) (book cover and back; pp. 2-3, 83).

International Search Report and Written Opinion in connection with PCT/US2009/056795 mailed on Apr. 20, 2010.

International Search Report and Written Opinion in connection with PCT/US2012/028576 mailed on Oct. 1, 2012.

International Search Report and Written Opinion in connection with PCT/US2012/028559 mailed on Oct. 19, 2012.

International Search Report and Written Opinion in connection with PCT/US2012/028534 mailed on Oct. 17, 2012.

International Preliminary Report on Patentability in connection with PCT/US2012/028534 mailed Sep. 17, 2013.

International Preliminary Report on Patentability in connection with PCT/US2012/028576 mailed Sep. 17, 2013.

* cited by examiner

ARTICLE OF FOOTWEAR INCORPORATING A KNITTED COMPONENT WITH MONOFILAMENT AREAS

CROSS-REFERENCE TO RELATED APPLICATION(S)

This non-provisional patent application claims the benefit of priority under 35 U.S.C. §119(e) to U.S. Provisional Application Ser. No. 62/043,450, which was filed in the U.S. Patent and Trademark Office on Aug. 29, 2014 and entitled "Article of Footwear Incorporating a Knitted Component with Monofilament Areas", the disclosure of which application is entirely incorporated herein by reference.

BACKGROUND

Conventional articles of footwear generally include two primary elements, an upper and a sole structure. The upper and the sole structure, at least in part, define a foot-receiving chamber that may be accessed by a user's foot through a foot-receiving opening. The sole structure is secured to a lower area of the upper, thereby being positioned between the upper and the ground.

In athletic footwear, for example, the sole structure may include a midsole and an outsole. The midsole often includes a polymer foam material that attenuates ground reaction forces to lessen stresses upon the foot and leg during walking, running, and other ambulatory activities. Additionally, the midsole may include fluid-filled chambers, plates, moderators, or other elements that further attenuate forces, enhance stability, or influence the motions of the foot. The outsole is secured to a lower surface of the midsole and provides a ground-engaging portion of the sole structure formed from a durable and wear-resistant material, such as rubber. The sole structure may also include a sockliner positioned within the void and proximal a lower surface of the foot to enhance footwear comfort.

A variety of material elements (e.g. textiles, polymer foam, polymer sheets, leather, synthetic leather) are conventionally utilized in manufacturing the upper. In athletic footwear, for example, the upper may have multiple layers that each includes a variety of joined material elements. As examples, the material elements may be selected to impart stretch-resistance, wear resistance, flexibility, air-permeability, compressibility, comfort, and moisture-wicking to different areas of the upper. In order to impart the different properties to different areas of the upper, material elements are often cut to desired shapes and then joined together, usually with stitching or adhesive bonding. Moreover, the material elements are often joined in layered configuration to impart multiple properties to the same areas.

As the number and type of material elements incorporated into the upper increases, the time and expense associated with transporting, stocking, cutting, and joining the material elements may also increase. Waste material from cutting and stitching processes also accumulates to a greater degree as the number and type of material elements incorporated into the upper increases. Moreover, uppers with a greater number of material elements may be more difficult to recycle than uppers formed from fewer types and number of material elements. Further, multiple pieces that are stitched together may cause a greater concentration of forces in certain areas. The stitch junctions may transfer stress at an uneven rate relative to other parts of the article of footwear which may cause failure or discomfort. Additional material and stitch joints may lead to discomfort when worn. By decreasing the number of material elements utilized in the upper, therefore, waste may be decreased while increasing the manufacturing efficiency, the comfort, performance, and the recyclability of the upper.

SUMMARY

In one aspect, an article of footwear includes a knitted component, the knitted component forms a substantial majority of the upper. The knitted component includes at least one monofilament area comprised of a monofilament strand, the at least one monofilament area having a shape. The article of footwear further includes a first welt formed using multifilament yarn, the first welt is constructed of at least two overlapping knit layers forming a first central unsecured area. The article further includes a second welt formed using multifilament yarn, the second welt constructed of at least two overlapping knit layers forming a second central unsecured area. At least one of the first welt and the second welt defines a portion of the shape of the at least one monofilament area and a tensile element extends through at least a portion of at least one of the first welt and the second welt.

In another aspect, an upper for an article of footwear includes a knitted component, the knitted component forms a substantial majority of the upper. The knitted component includes at least one monofilament area comprised of a monofilament strand, the at least one monofilament area having a shape. The upper further includes a first welt formed using multifilament yarn, the first welt is constructed of at least two overlapping knit layers forming a first central unsecured area. The upper further includes a second welt formed using multifilament yarn, the second welt constructed of at least two overlapping knit layers forming a second central unsecured area. At least one of the first welt and the second welt defines a portion of the shape of the at least one monofilament area and a tensile element extends through at least a portion of at least one of the first welt and the second welt.

In another aspect, a method of manufacturing an article of footwear comprising includes knitting a knitted component, the knitted component comprising a substantial majority of the upper the knitted component including at least one monofilament area comprised of a monofilament strand, the at least one monofilament area having a shape. The method further comprising, knitting a first welt formed using a multifilament yarn, the first welt constructed of at least two overlapping knit layers forming a void. The method further comprising knitting a second welt formed using a multifilament yarn, the second welt constructed of at least two overlapping knit layers forming a void. The at least one of the first welt and the second welt defining a portion of the shape of the at least one monofilament area.

Other systems, methods, features and advantages of the embodiments will be, or will become, apparent to one of ordinary skill in the art upon examination of the following figures and detailed description. It is intended that all such additional systems, methods, features and advantages be included within this description and this summary, be within the scope of the embodiments, and be protected by the following claims.

BRIEF DESCRIPTION OF THE DRAWINGS

The invention can be better understood with reference to the following drawings and description. The components in the figures are not necessarily to scale, emphasis instead being placed upon illustrating the principles of the invention.

Moreover, in the figures, like reference numerals designate corresponding parts throughout the different views.

The foregoing Summary and the following Detailed Description will be better understood when read in conjunction with the accompanying Figures.

Figure 1:
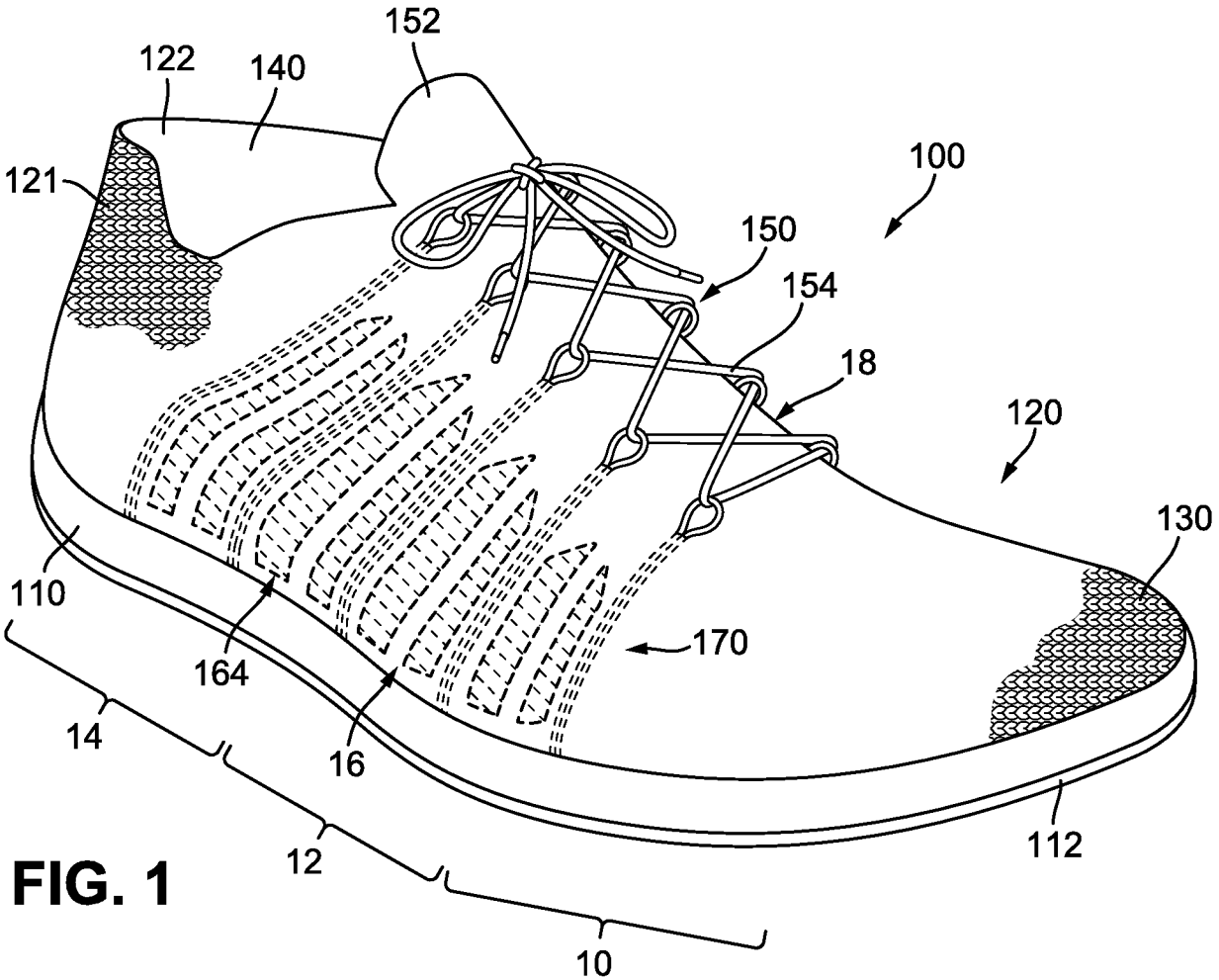
Figure 2:
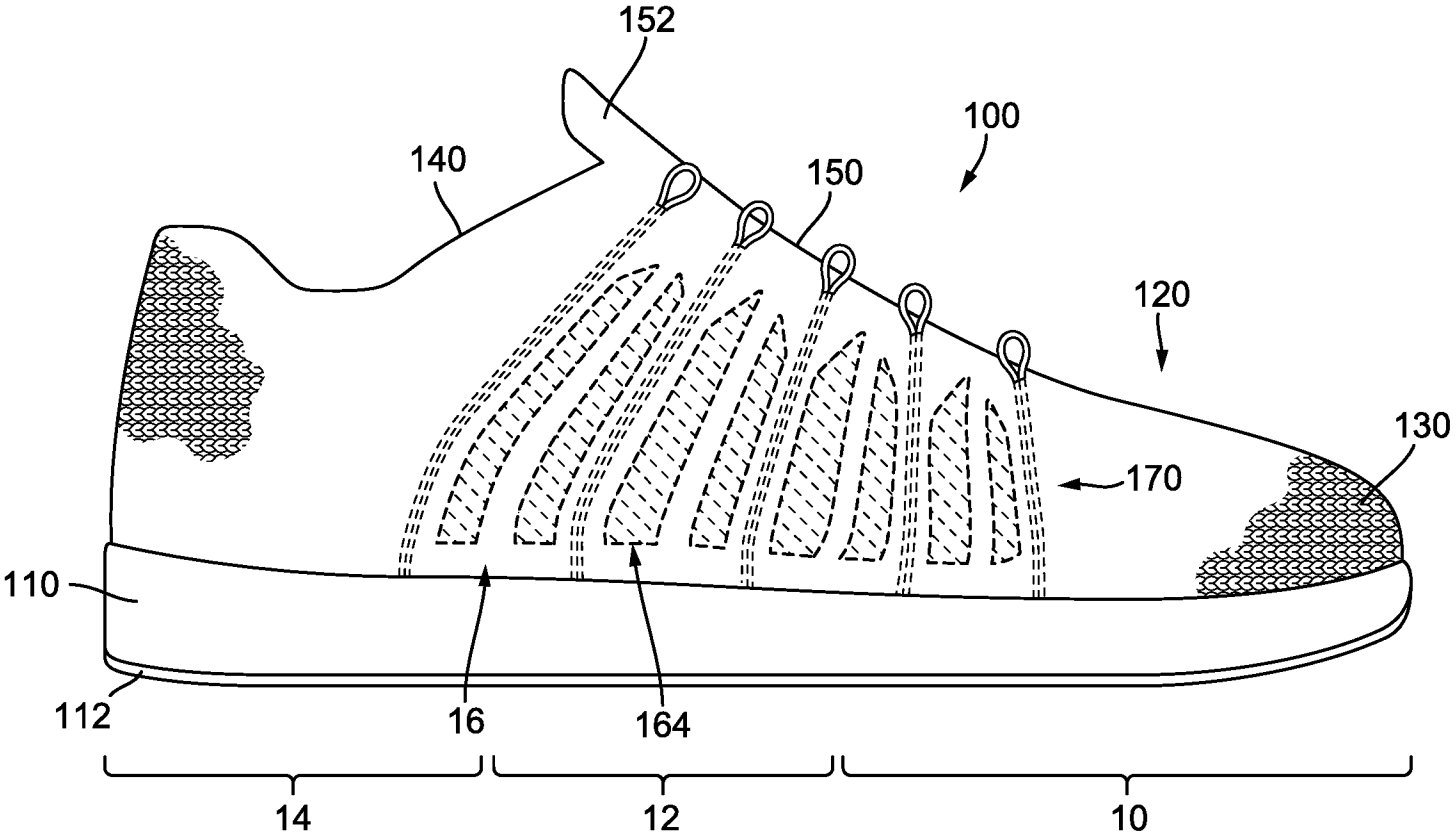
Figure 3:
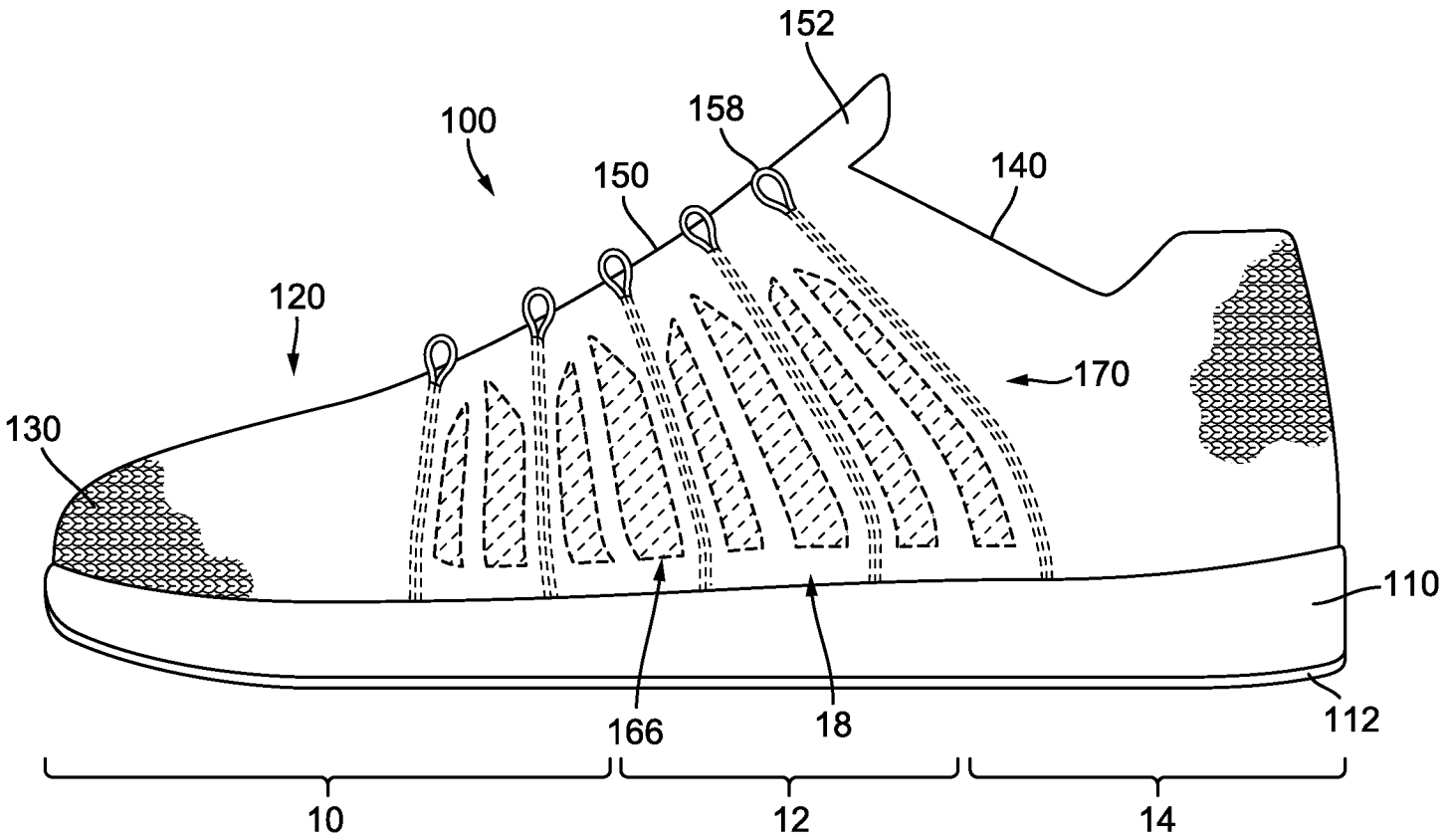
Figure 4:
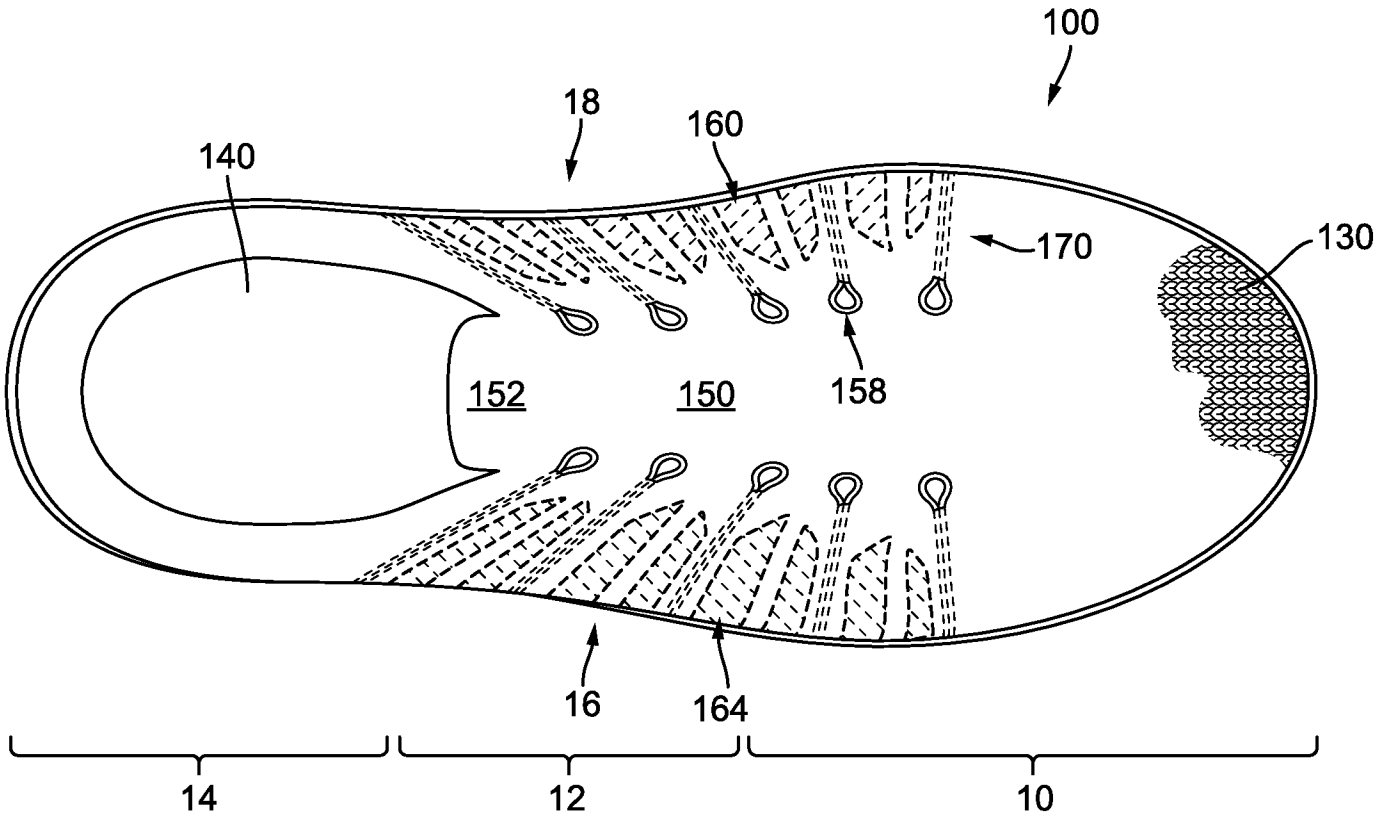
Figure 5:
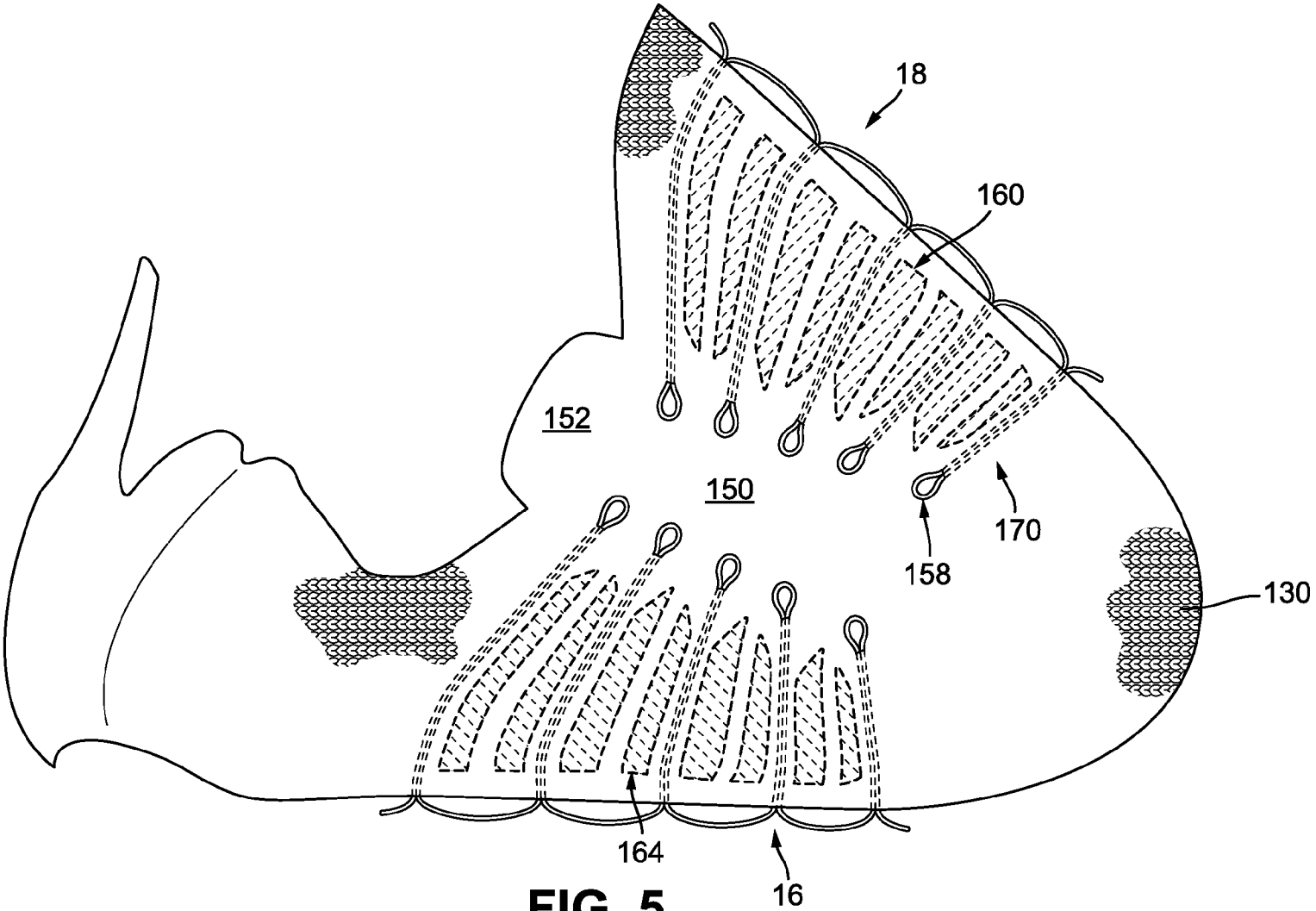
Figure 6:
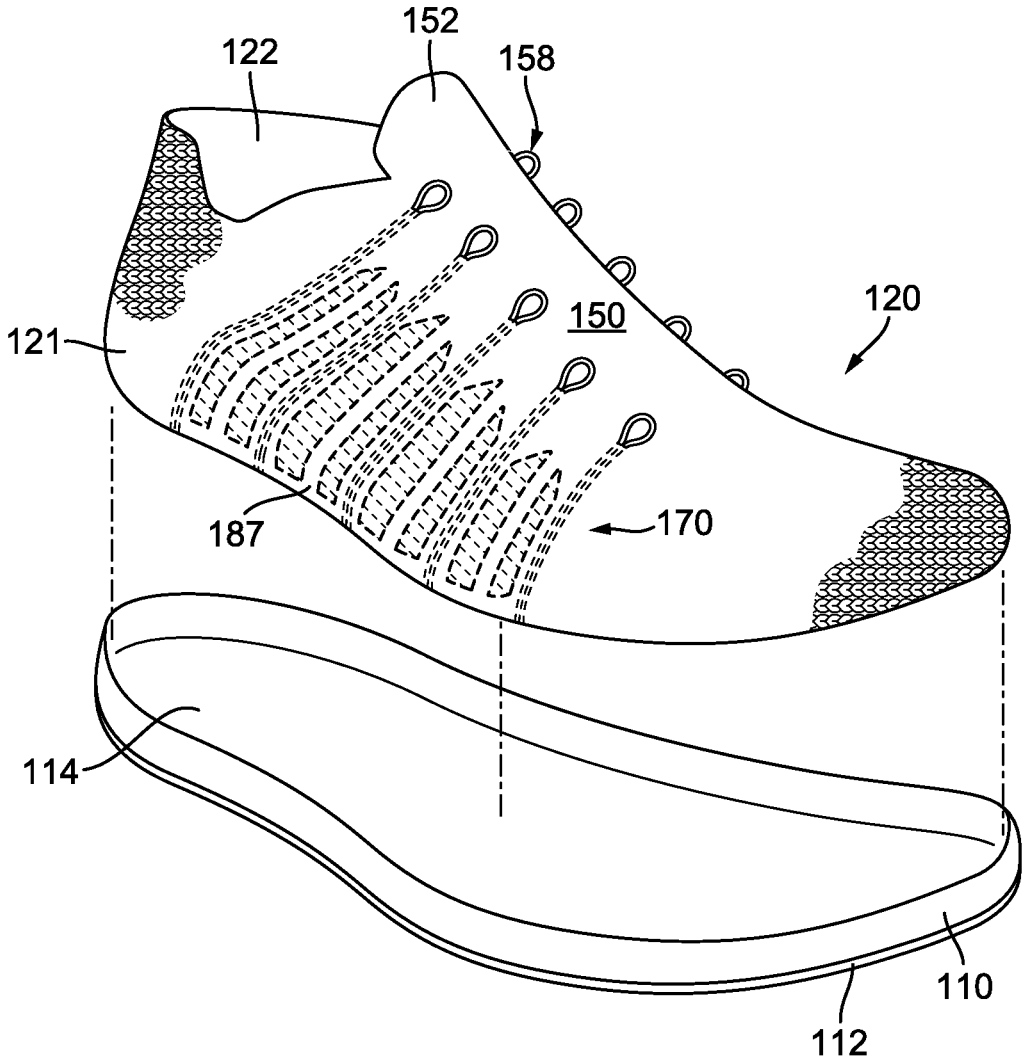
Figure 7:
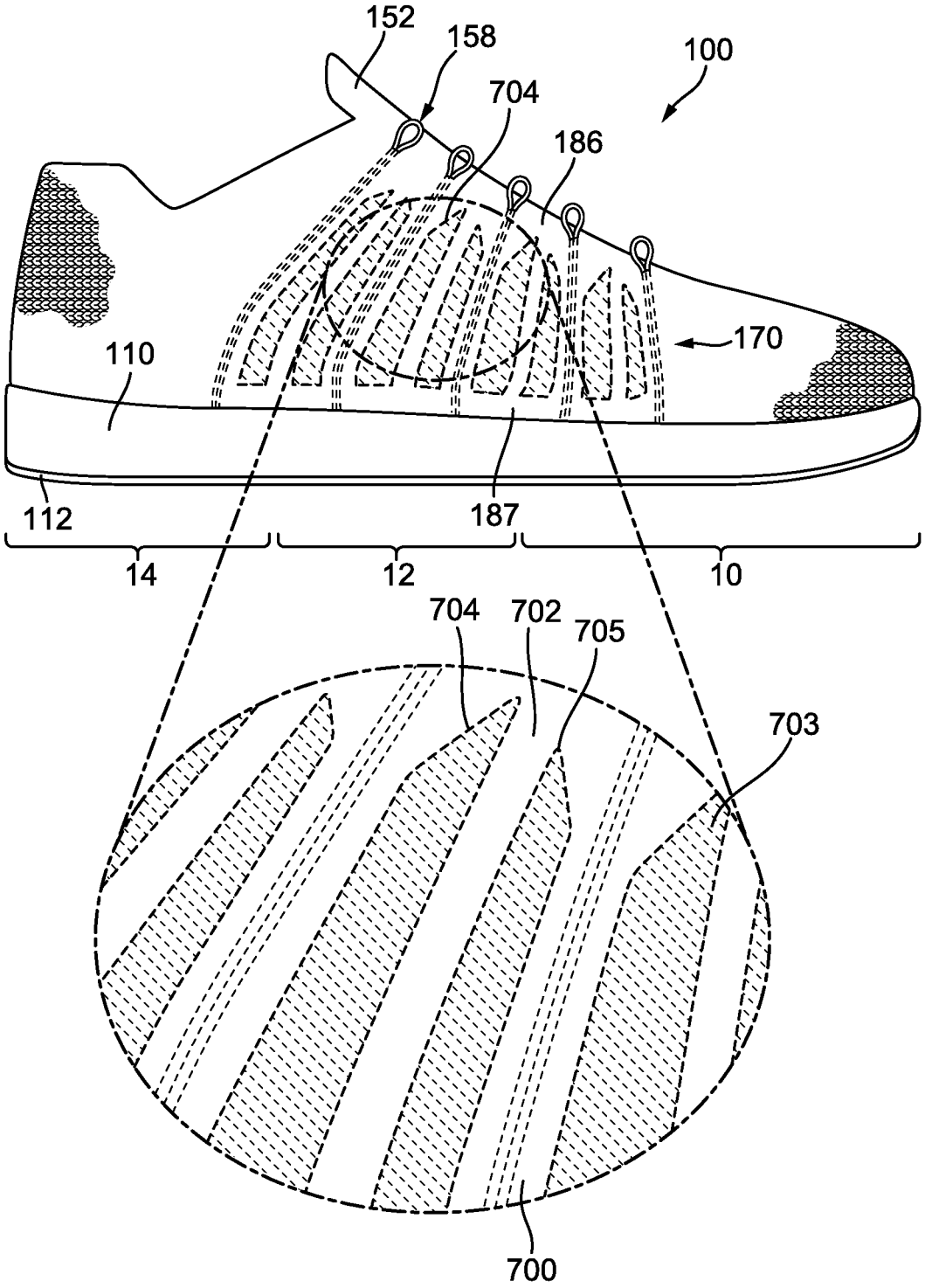
Figure 8:
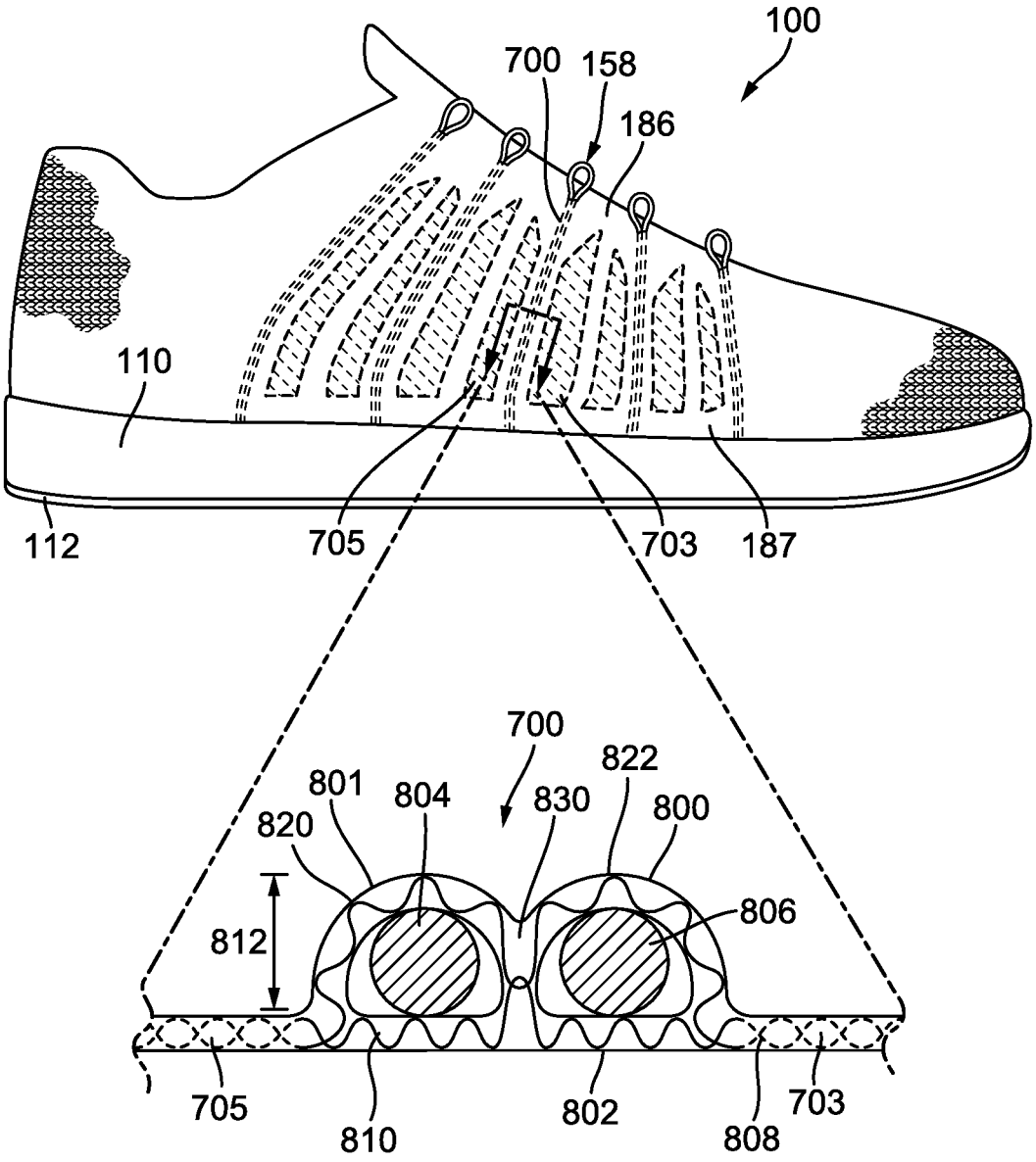
Figure 9:
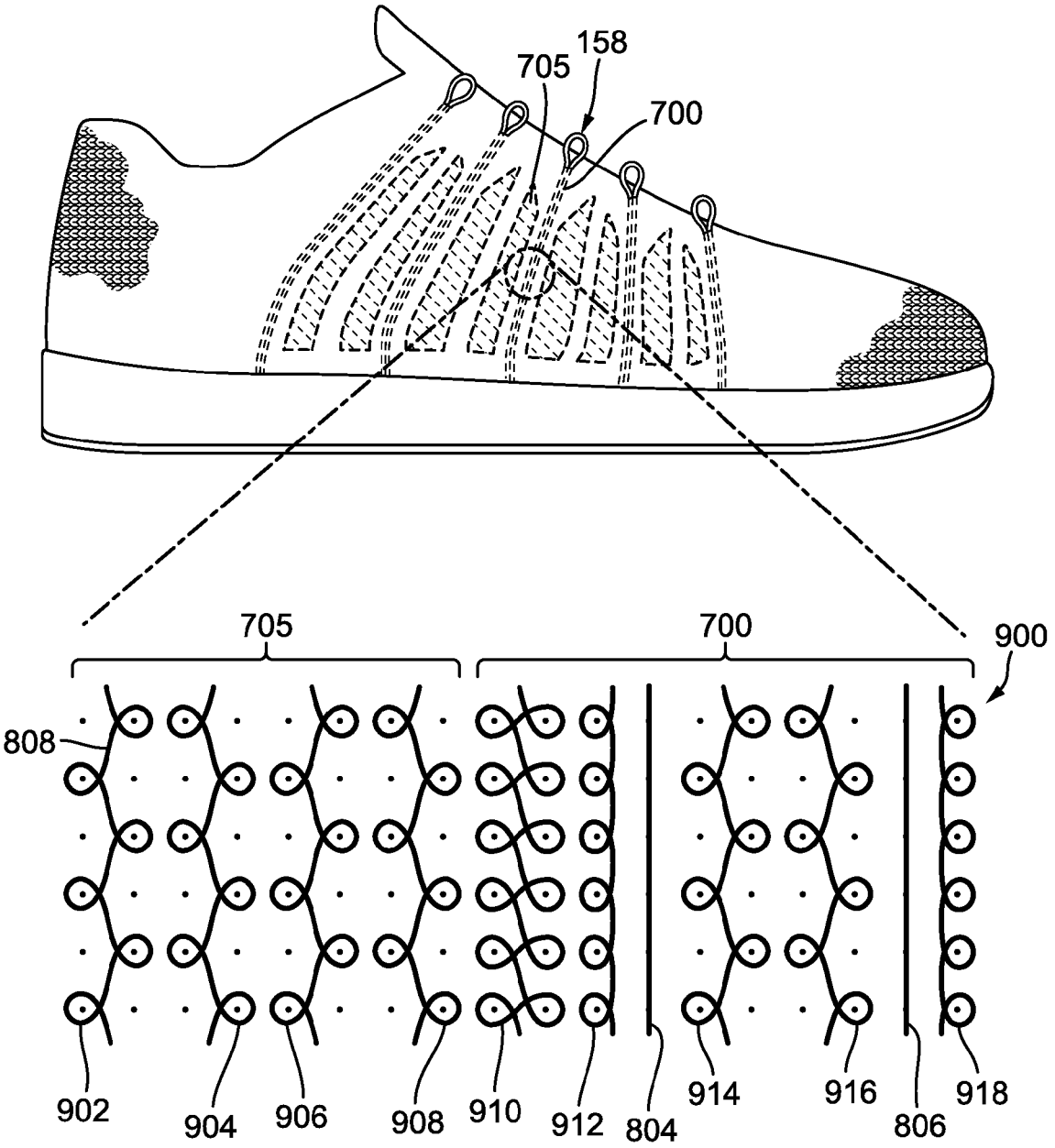
Figure 10:
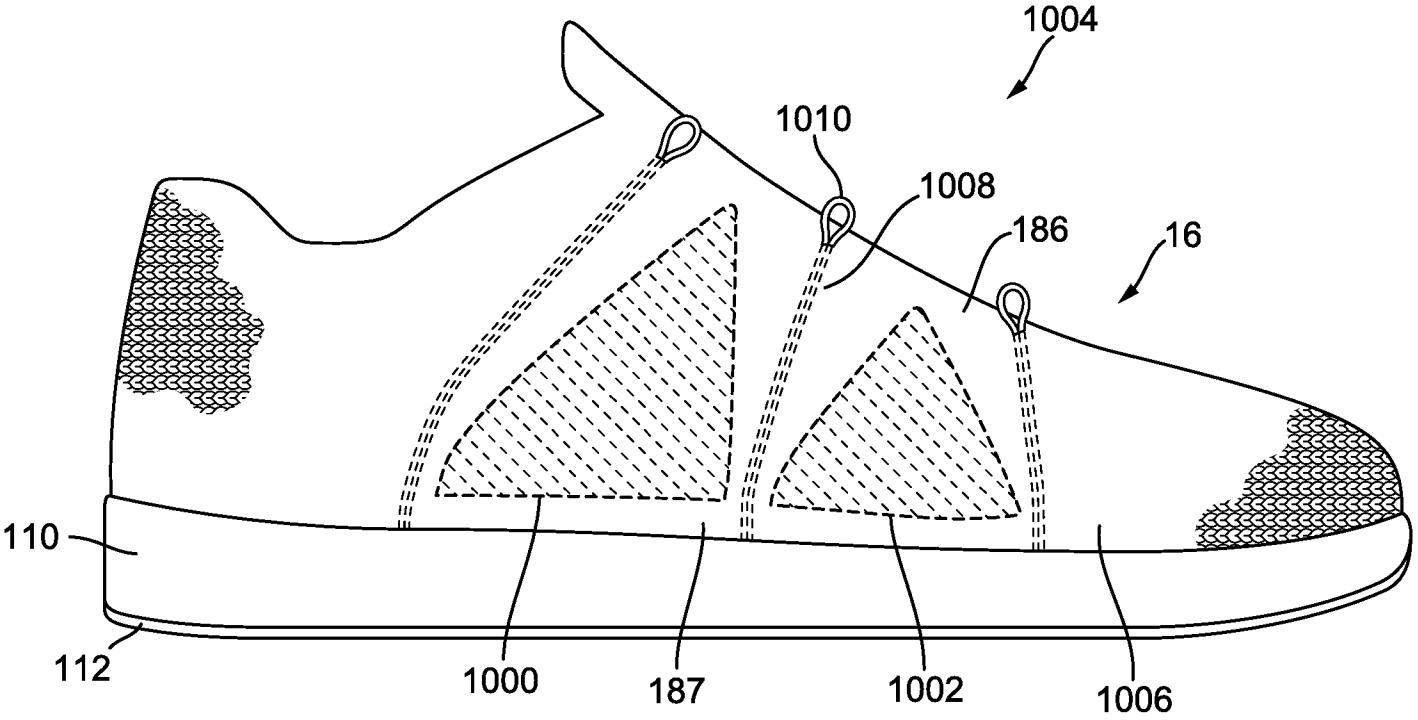
Figure 11:
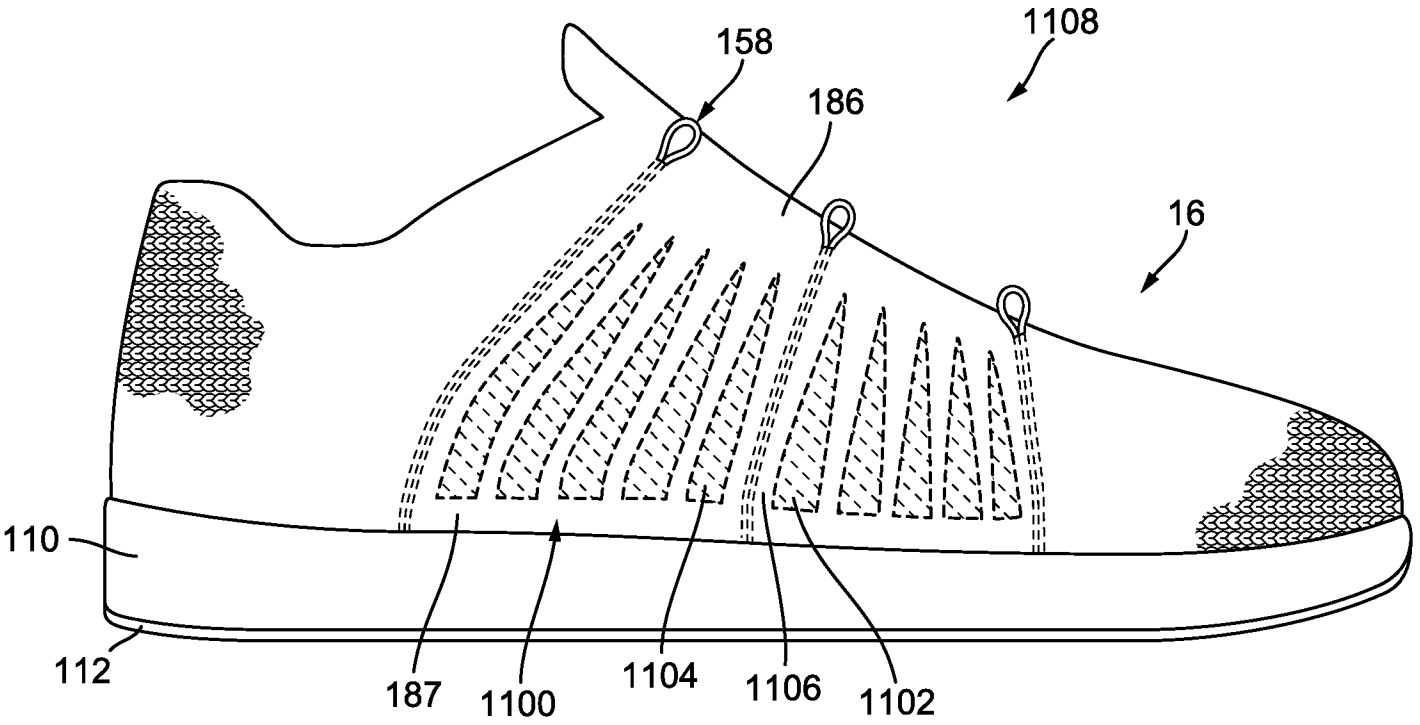

FIG. 1 is an isometric view of an embodiment of an article of footwear;

FIG. 2 is a lateral side view of an embodiment of an article of footwear;

FIG. 3 is a medial side view of an embodiment of an article of footwear;

FIG. 4 is a top view of an embodiment of an article of footwear;

FIG. 5 is a top view of an embodiment of a knitted component incorporated into an upper of an article of footwear;

FIG. 6 is an exploded view of the components of an embodiment of an article of footwear with an upper incorporating a knitted component;

FIG. 7 is an enlarged view of an embodiment of welts within a portion of a knitted component;

FIG. 8 is a cross-section of an embodiment of a welt enclosing tensile elements;

FIG. 9 is a looping diagram of an embodiment of the knitting configuration for a welt enclosing tensile elements;

FIG. 10 is a lateral side view of an alternate embodiment of an article of footwear incorporating large monofilament areas;

FIG. 11 is a lateral side view of another alternate embodiment of an article of footwear incorporating multiple smaller monofilament areas.

Figure 12:
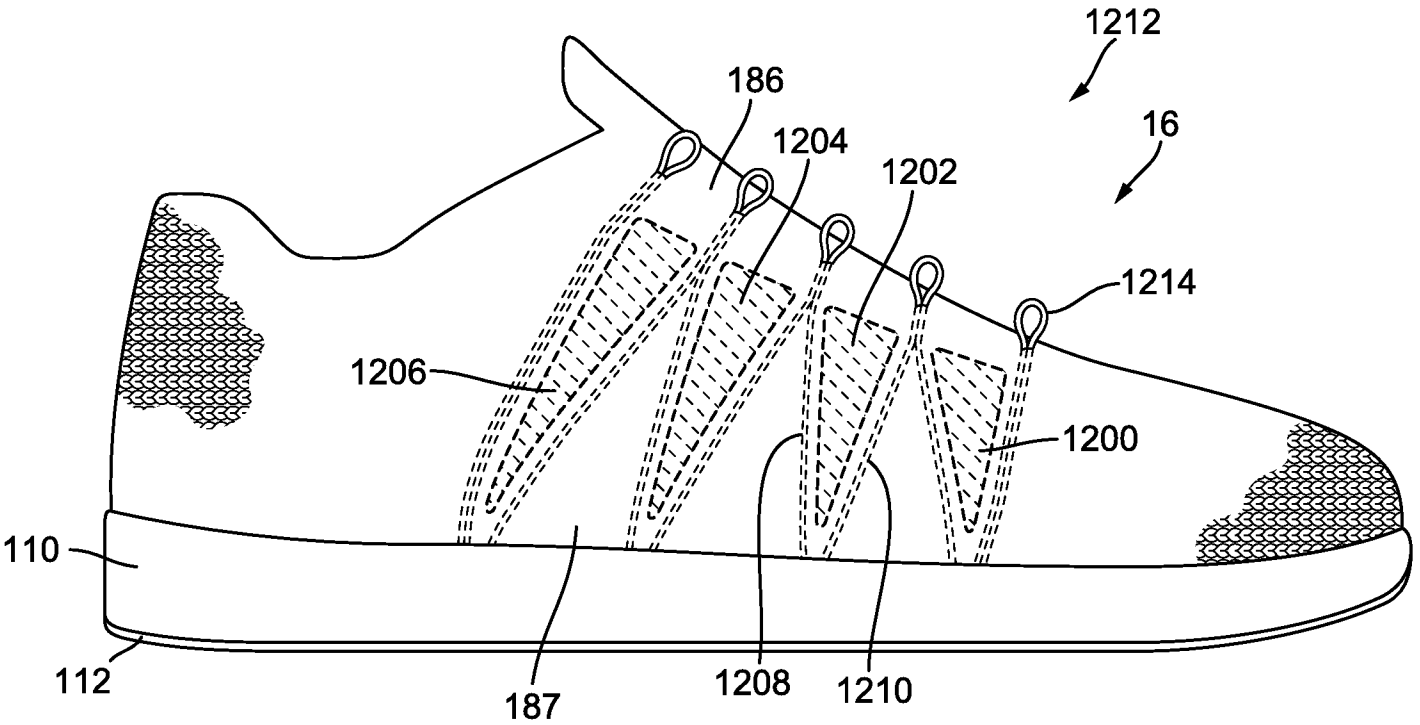
Figure 13:
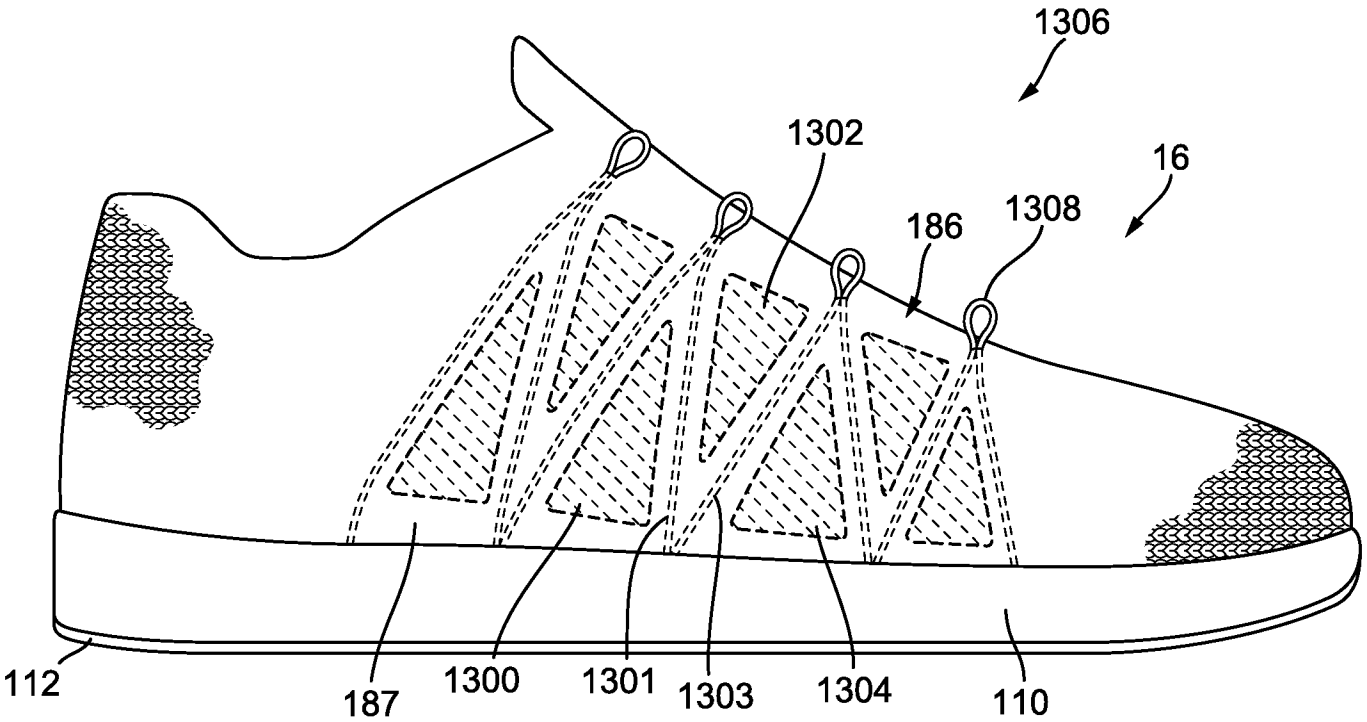
Figure 14:
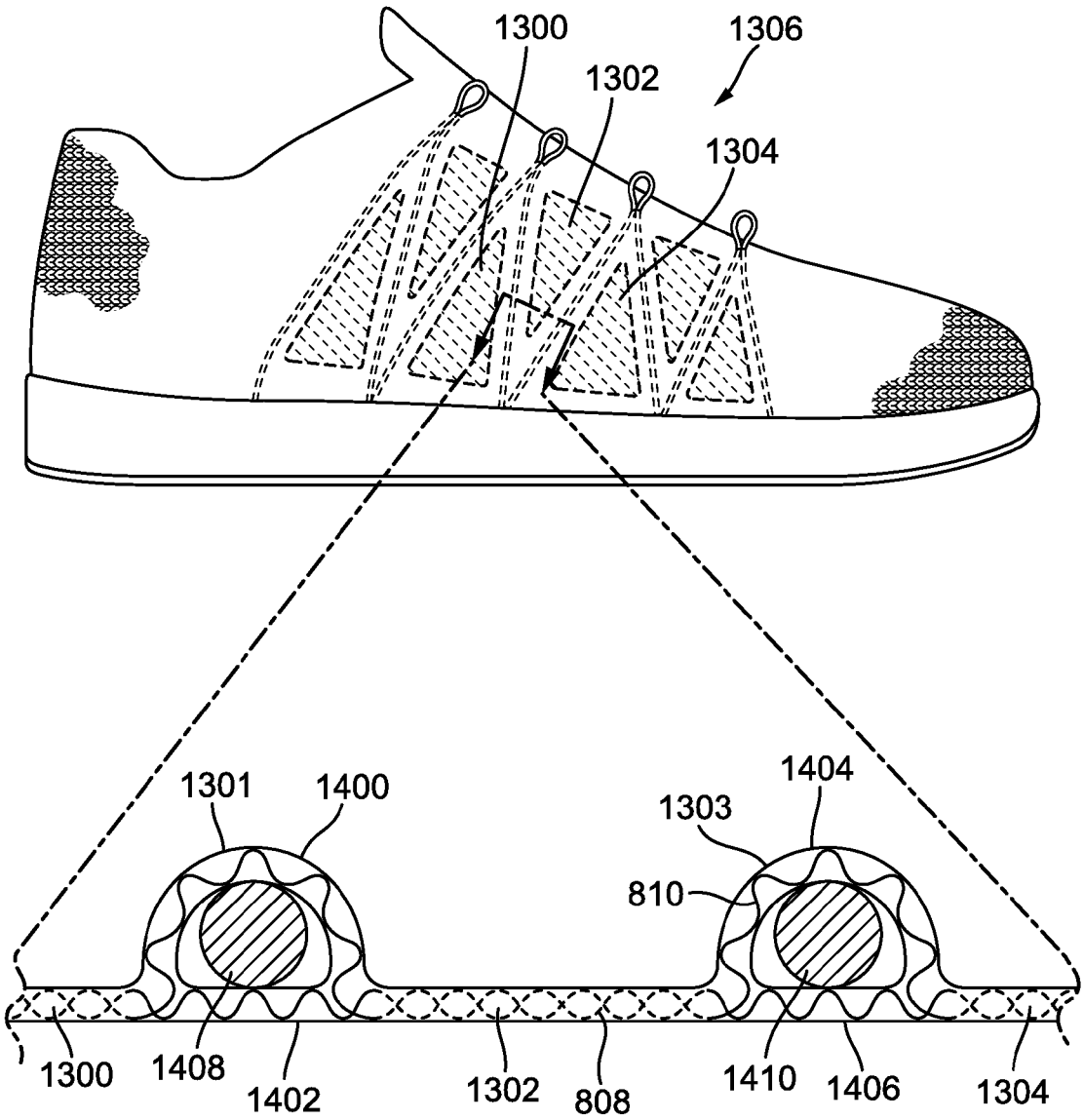

FIG. 12 is a lateral side view of another alternate embodiment of an article of footwear incorporating monofilament areas;

FIG. 13 is a lateral side view of another alternate embodiment of an article of footwear incorporating monofilament areas;

FIG. 14 is a cross-section of an embodiment of welts.

DETAILED DESCRIPTION

The following discussion and accompanying Figures disclose a variety of concepts relating to knitted components and the manufacture of knitted components. Although the knitted components may be utilized in a variety of products, an article of footwear that incorporates one of the knitted components is disclosed below as an example. In addition to footwear, the knitted components may be utilized in other types of apparel (e.g., shirts, pants, socks, jackets, undergarments), athletic equipment (e.g., golf bags, baseball and football gloves, soccer ball restriction structures), containers (e.g., backpacks, bags), and upholstery for furniture (e.g., chairs, couches, car seats). The knitted components may also be utilized in bed coverings (e.g., sheets, blankets), table coverings, towels, flags, tents, sails, and parachutes. The knitted components may be utilized as technical textiles for industrial purposes, including structures for automotive and aerospace applications, filter materials, medical textiles (e.g. bandages, swabs, implants), geotextiles for reinforcing embankments, agrotextiles for crop protection, and industrial apparel that protects or insulates against heat and radiation. Accordingly, the knitted components and other concepts disclosed herein may be incorporated into a variety of products for both personal and industrial purposes.

For consistency and convenience, directional adjectives are employed throughout this detailed description corresponding to the illustrated embodiments. The term "longitudinal" as used throughout this Detailed Description and in the claims refers to a direction extending a length or major axis of an article. In some cases, the longitudinal direction may extend from a forefoot region to a heel region of the article. Also, the term "lateral" as used throughout this Detailed Description and in the claims refers to a direction extending a width or minor axis of an article. In other words, the lateral direction may extend between a medial side and a lateral side of an article. Furthermore, the term "vertical" as used throughout this Detailed Description and in the claims refers to a direction generally perpendicular to a lateral and longitudinal direction. For example, in cases where an article is planted flat on a ground surface, the vertical direction may extend from the ground surface upward. It will be understood that each of these directional adjectives may be applied to individual components of an article, including an upper, a knitted component and portions thereof, and/or a sole structure.

Footwear Configuration

FIGS. 1 through 4 illustrate an exemplary embodiment of an article of footwear 100, also referred to simply as article 100. In some embodiments, article 100 may include a sole structure 110 and an upper 120. Although article 100 is illustrated as having a general configuration suitable for running, concepts associated with article 100 may also be applied to a variety of other athletic footwear types, including basketball shoes, baseball shoes, soccer shoes, cycling shoes, football shoes, tennis shoes, training shoes, walking shoes, and hiking boots, for example. The concepts may also be applied to footwear types that are generally considered to be non-athletic, including dress shoes, loafers, sandals, and work boots. Accordingly, the concepts disclosed with respect to article 100 may be applied to a wide variety of footwear types.

For reference purposes, article 100 may be divided into three general regions: a forefoot region 10, a midfoot region 12, and a heel region 14, as shown in FIGS. 1, 2, and 3. Forefoot region 10 generally includes portions of article 100 corresponding with the toes and the joints connecting the metatarsals with the phalanges. Midfoot region 12 generally includes portions of article 100 corresponding with an arch area of the foot. Heel region 14 generally corresponds with rear portions of the foot, including the calcaneus bone. Article 100 also includes a lateral side 16 and a medial side 18, which extend through each of forefoot region 10, midfoot region 12, and heel region 14 and correspond with opposite sides of article 100. More particularly, lateral side 16 corresponds with an outside area of the foot (i.e., the surface that faces away from the other foot), and medial side 18 corresponds with an inside area of the foot (i.e., the surface that faces toward the other foot). Forefoot region 10, midfoot region 12, and heel region 14 and lateral side 16, medial side 18 are not intended to demarcate precise areas of article 100. Rather, forefoot region 10, midfoot region 12, and heel region 14, and lateral side 16 and medial side 18 are intended to represent general areas of article 100 to aid in the following discussion. In addition to article 100, forefoot region 10, midfoot region 12, and heel region 14 and lateral side 16, medial side 18 may also be applied to sole structure 110, upper 120, and individual elements thereof.

In an exemplary embodiment, sole structure 110 is secured to upper 120 and extends between the foot and the ground when article 100 is worn. In some embodiments, sole structure 110 may include one or more components, including a midsole, an outsole, and/or a sockliner or insole. In an exemplary embodiment, sole structure 110 may include an outsole 112 that is secured to a lower surface of upper 120 and/or a base portion configured for securing sole structure 110 to upper 120. In one embodiment, outsole 112 may be formed from a wear-resistant rubber material that is textured to impart traction. In this embodiment, outsole 112 is configured to provide traction suitable for use on a running surface. Although this configuration for sole structure 110 provides an example of a sole structure that may be used in connection with upper 120, a variety of other conventional or nonconventional configurations for sole structure 110 may also be used. Accordingly, in other embodiments, the features of sole structure 110 or any sole structure used with upper 120 may vary.

In other embodiments, sole structure 110 may include a midsole and/or a sockliner. A midsole may be secured to a lower surface of an upper and in some cases may be formed from a compressible polymer foam element (e.g., a polyurethane or ethylvinylacetate foam) that attenuates ground reaction forces (i.e., provides cushioning) when compressed between the foot and the ground during walking, running, or other ambulatory activities. In other cases, a midsole may incorporate plates, moderators, fluid-filled chambers, lasting elements, or motion control members that further attenuate forces, enhance stability, or influence the motions of the foot. In still other cases, the midsole may be primarily formed from a fluid-filled chamber that is located within an upper and is positioned to extend under a lower surface of the foot to enhance the comfort of an article.

In some embodiments, upper 120 defines a void within article 100 for receiving and securing a foot relative to sole structure 110. The void is shaped to accommodate the foot and extends along a lateral side of the foot, along a medial side of the foot, over the foot, around the heel, and under the foot. Upper 120 includes an exterior surface 121 and an opposite interior surface 122. Exterior surface 121 faces outward and away from article 100, whereas interior surface 122 faces inward and defines a majority or a relatively large portion of the void within article 100 for receiving the foot. Moreover, interior surface 122 may lay against the foot or a sock covering the foot. Access to the void is provided by a throat opening 140 located in at least heel region 14. More particularly, the foot may be inserted into upper 120 through throat opening 140, and the foot may be withdrawn from upper 120 through throat opening 140. In some embodiments, an instep area 150 extends from throat opening 140 in heel region 14 over an area corresponding to an instep of the foot to an area adjacent to forefoot region 10.

A lace 154 extends through a plurality of loops 158 in upper 120 and permits the wearer to modify dimensions of upper 120 to accommodate proportions of the foot. More particularly, lace 154 permits the wearer to tighten upper 120 around the foot, and lace 154 permits the wearer to loosen upper 120 to facilitate entry and removal of the foot from the void (i.e., through throat opening 140). In addition, a tongue 152 extends through instep area 150 from a forward portion of upper 120 in forefoot region 10 to a top portion of upper 120 adjacent to throat opening 140 in heel region 14. In this embodiment, tongue 152 extends under lace 154 to enhance the comfort of article 100. In addition to, or in alternative of loops 158, article 100 may include other lace-receiving elements, such as D-rings, hooks, or various looped tensile elements. In further configurations, upper 120 may include additional elements, such as (a) a heel counter in heel region 14 that enhances stability, (b) a toe guard in forefoot region 10 that is formed of a wear-resistant material, and (c) logos, trademarks, and placards with care instructions and material information.

Many conventional footwear uppers are formed from multiple material elements (e.g., textiles, polymer foam, polymer sheets, leather, synthetic leather) that are joined through stitching or bonding, for example. In contrast, in some embodiments, a majority of upper 120 is formed from a knitted component 130. Knitted component 130 is formed from at least one yarn that is manipulated (e.g., with a knitting machine) to form a plurality of intermeshed loops that define a variety of courses and wales. That is, knitted component 130 has the structure of a knit textile. Knitted component 130 may, for example, be manufactured through a flat knitting process and extends through each of each of forefoot region 10, midfoot region 12, and heel region 14, along both lateral side 16 and medial side 18, over forefoot region 10, and around heel region 14. In an exemplary embodiment, knitted component 130 forms substantially all of upper 120, including exterior surface 121 and a majority or a relatively large portion of interior surface 122, thereby defining a portion of the void within upper 120 In some embodiments, knitted component 130 may also extend under the foot. In some embodiments, knitted component 130 may be secured to upper surface 114 of sole structure 110. In other embodiments, however, a strobel sock or thin sole-shaped piece of material is secured to knitted component 130 to form a base portion of upper 120 that extends under the foot for attachment with sole structure 110.

In some embodiments, upper 120 may include distinct areas with differing properties. In some embodiments, a portion of upper 120 may include multifilament yarn. In some embodiments, a portion of upper 120 may include monofilament strands. Monofilament strands may be made from a plastic or polymer material that is extruded to form the monofilament strand. Generally, monofilament strands may be lightweight and have a high tensile strength, i.e., are able to sustain a large degree of stress prior to tensile failure or breaking, so as to provide a large amount or degree of resistance to stretch to upper 120. In an exemplary embodiment, portions of upper 120 that include monofilament strands may be located in one or more monofilament areas. The term "monofilament areas" is used to reference a portion of upper 120 that is formed substantially entirely from knitted monofilament strands.

In some embodiments, monofilament groups may be located on various portions of upper 120. In an exemplary embodiment, one or more monofilament groups may be located throughout article 100. In one embodiment, a medial monofilament group 160 is disposed on medial side 18 of upper 120 and a lateral monofilament group 164 disposed on lateral side 16 of upper 120. Medial monofilament group 160 and lateral monofilament group 164 may be generally located in midfoot region 12. Additionally, in some embodiments, monofilament groups may be located in forefoot region 10 and heel region 14. Monofilament groups may comprise multiple monofilament areas described in detail later in the detailed description. Additionally, in some embodiments, monofilament groups may comprise monofilament areas that are arranged in a certain orientation. For example, referring to lateral monofilament group 164, some of the monofilament areas are oriented in similar diagonal orientation. Although monofilament groups may include similarly situated monofilament areas, in other embodiments monofilament groups may include variously oriented monofilament areas.

Although seams may be present in the portions of knitted component 130, a majority of the knitted component 130 has a substantially seamless configuration. As utilized herein, a knitted component is defined as being formed of "unitary knit construction" when formed as a one-piece element through a knitting process. That is, the knitting process substantially forms the various features and structures of the knitted component portion without the need for significant additional manufacturing steps or processes. A unitary knit construction may be used to form a knitted component portion having structures or elements that include one or more courses of yarn or other knit material that are joined such that the structures or elements include at least one course in common (i.e., sharing a common yarn) and/or include courses that are substantially continuous between each of the structures or elements. With this arrangement, a one-piece element of unitary knit construction is provided.

Examples of various configurations of knitted components, including configurations that include an inlaid strand or tensile element, that may be used for one or more of the portions of knitted component 130 are disclosed in U.S. Pat. No. 6,931,762 to Dua; U.S. Pat. No. 7,347,011 to Dua, et al.; U.S. Patent Application Publication 2008/0110048 to Dua, et al.; and U.S. Patent Application Publication 2010/0154256 to Dua, the disclosures of each of which are entirely incorporated herein by reference.

As shown in FIG. 5, knitted component 130 may be formed largely as a two-dimensional structure, that when assembled may take the shape of a three-dimensional structure. In the view of FIG. 5, monofilament areas of medial monofilament group 160 extend in a lateral direction. Likewise, monofilament areas of lateral monofilament group 164 extend largely in a lateral direction. As shown in FIG. 6, however, monofilament areas extend largely in a vertical direction when upper 120 is formed into a three-dimensional structure.

Knitted Component Configuration

Although the respective portions of knitted component 130 may be formed by hand, the commercial manufacture of multiple knitted components 130 will generally be performed by knitting machines. Knitted component 130 may be formed using a variety of different knitting processes and using a variety of different knitting machines including, but not limited to warp knitting or weft knitting, including, flat knitting (i.e., the use of a flat knitting machine) or circular knitting, with the capability of forming knitted component 130 and/or knitted component portions. In general, weft knitting involves forming a plurality of courses and wales. As an example, courses are rows of intermeshed loops of knit material that extend approximately laterally across knitted component 130. That is, courses may extend along the width of knitted component 130. Courses located within heel region 12, however, are approximately perpendicular to courses within forefoot region 10 when knitted component 130 is assembled into a three-dimensional structure. Wales are columns of loops that extend perpendicular to the courses and extend generally along a length of each of upper 120.

In the exemplary embodiments, a flat knitting process may be used to form knitted component 130 and/or knitted component portions. In other embodiments, circular knitting (i.e., the use of a circular knitting machine) may be used to form knitted component 130. Although general or conventional knitting processes may be used to form knitted component 130 and/or the knitted component portions, specific examples of knitting processes that may be used include, but are not limited to: warp knitting and/or weft knitting, including flat knitting, circular knitting, wide tube circular knitting, narrow tube circular knitting, narrow tube circular knit jacquard, single knit circular knit jacquard, double knit circular knit jacquard, and warp knit jacquard, for example.

Knitted component 130 may be formed from a single type of yarn that imparts common properties to each of the individual portions. In order to vary the properties of knitted component 130, however, different yarns may be utilized in different portions of knitted component 130. That is, different regions of knitted component 130 may be formed from different yarns to vary the properties between portions or areas of knitted component 130. Further, monofilament areas may be formed from a monofilament strand imparting different properties within monofilament areas as compared to other areas of knitted component 130. In some embodiments, monofilament areas may be formed using a single monofilament strand. In other embodiments, monofilament areas may be formed using a monofilament strand and fusible thermoplastic yarn. In some embodiments, the fusible thermoplastic yarn and monofilament strand may be in a plated orientation. In some embodiments, the thermoplastic yarn may stabilize or strengthen monofilament areas or portions of monofilament areas. Moreover, one portion of knitted component 130 may be formed from a first type of yarn or combination of yarns that imparts a first set of properties, and another portion of knitted component 130 may be formed from a second type of yarn or combination of yarns that imparts a second set of properties. Properties may vary throughout portions of knitted component 130, therefore, by selecting specific yarns for different portions of knitted component 130. Examples of properties that may be varied through choice of yarn include color, pattern, luster, stretch, recovery, loft, hand, moisture absorption, biodegradability, abrasion-resistance, durability, and thermal conductivity. It should also be noted that two or more yarns may be utilized in combination to take advantage of properties from both yarns, such as when yarns are plated or form different courses in the same area.

The properties that a particular type of yarn will impart to a portion of knitted component 130 partially depend upon the materials that form the various filaments and fibers within the yarn. Cotton, for example, provides a soft hand, natural aesthetics, and biodegradability. Elastane and stretch polyester each provide substantial stretch and recovery, with stretch polyester also providing recyclability. Rayon provides high luster and moisture absorption. Wool also provides high moisture absorption, in addition to insulating properties and biodegradability. Nylon is durable, abrasion-resistant, and has relatively high strength. Polyester is a hydrophobic material that also provides relatively high durability. Yarns that incorporate thermoplastic materials may also permit portions or areas of knitted component 130 to be fused or stabilized through the application of heat.

In addition to materials, other aspects of the yarns selected for portions or areas of knitted component 130 may affect properties. For example, a yarn forming knitted component 130, may be a monofilament strand or a multifilament yarn. The yarn may also include separate filaments that are each formed of different materials. In addition, the yarn may include filaments that are each formed of two or more different materials, such as a bi-component yarn with filaments having a sheath-core configuration or two halves formed of different materials. Different degrees of twist and crimping, as well as different deniers, may also affect the properties of knitted component 130 and the individual portions thereof. Accordingly, both the materials forming the yarn and other aspects of the yarn may be selected to impart a variety of properties to separate portions of knitted component 130.

In some embodiments, multifilament yarn may be used to form a portion of knitted component 130. In some embodiments, multifilament yarn may have differing properties than the properties of monofilament strands. In some embodiments, multifilament yarn may have a higher resistance to abrasion than monofilament strands. Multifilament yarn may be formed from many different materials as discussed previously in the detailed description.

In some embodiments, portions of knitted component 130 may be formed from monofilament strands. In addition, other portions of knitted component 130 may be formed from multifilament yarn. Additionally, although certain areas of knitted component 130 may be formed from different strands or yarns, knitted component 130 may still be of unitary knit construction. For example, monofilament areas or portions may be knit adjacent to multifilament portions and thereby form a unitary knit structure. In some embodiments, monofilament areas discussed above may include monofilament strands. A monofilament area refers to a monofilament portion of knitted component 130. In some embodiments, a monofilament area may be comprised solely of a monofilament structure. That is, in some embodiments, monofilament areas may not include other yarns or strands. In some embodiments, monofilament areas may be adjacent to or bounded by multifilament structures.

In some embodiments, monofilament areas may be adjacent to tubes or channels or welts. Generally, welts can be areas of knitted component 130 constructed with two or more co-extensive and overlapping knit layers. Knit layers may be portions of knitted component 130 that are formed from knitted material, for example, threads, yarns, or strands. Two or more knit layers may be formed of unitary knit construction in such a manner so as to form tubes or tunnels, identified as welts 170, in knitted component 130. Although the sides or edges of the knit layers forming welts 170 may be secured to the other layer, a central area is generally unsecured to form a hollow between the two layers of knitted material forming each knit layer. In some embodiments, the central area of welts 170 may be configured such that another element (e.g., a tensile element) may be located between and extend or pass through the hollow between the two knit layers forming welts 170. In an exemplary embodiment, each of the layers forming welts 170 may be associated with one of exterior surface 121 and interior surface 122 of knitted component 170. For example, in one embodiment, welts 170 may include an interior portion associated with interior surface 122 and an exterior portion associate with exterior surface 121.

In some embodiments, tubes or welts may be formed from multifilament yarn. In some embodiments, welts may include inlaid strands or tensile elements extending through the welts. Mesh knit structures, mock mesh knit structures, and other suitable knit structures with accompanying looping diagrams for knitting such knit structures for use in the present embodiments are described in U.S. Patent Application Publication 2012/0233882 to Huffa et al., which is incorporated herein.

In some embodiments, welts 170 may be located throughout upper 120. In some embodiments, welts 170 may be located adjacent to monofilament areas. In some embodiments, welts 170 may comprise an interior portion 802 and an exterior portion 800. Interior portion 802 may be located adjacent the foot of a user. Exterior portion 800 may be connected to interior portion 802 along the edges of interior portion 802 so as to form an opening between exterior portion 800 and interior portion 802. In some embodiments, exterior portion 800 may extend away from the foot of a user.

In some embodiments, monofilament areas may be located toward interior surface 122 of knitted component 130. That is, monofilament areas may be located toward the foot of a user. In some embodiments, monofilament areas may be aligned with interior portion 802 of the welts. That is, in some embodiments, monofilament areas may extend along a plane that is similarly aligned with the plane along which interior portion 802 is formed. As such, monofilament areas may be set back from exterior portion 800 of the welts. In some embodiments, such a configuration may be utilized in order to increase the likelihood that exterior portion 800 may be contacted before monofilament areas. In this manner, monofilament areas may be protected from abrasion.

In some embodiments, the width of monofilament areas may reduce the likelihood of monofilament areas being subjected to abrasion. In some embodiments, monofilament areas may be relatively narrow, for example, approximately four courses wide. In other embodiments, monofilament areas may be wider. Additionally, in some embodiments, welts 170 may be approximately the same width as monofilament areas. In other embodiments, welts 170 may be wider or narrower. In embodiments in which welts 170 and monofilament areas are approximately the same width, approximately 50% of the area encompassed by welts 170 and monofilament areas may comprise a purely monofilament structure. That is, in some embodiments, approximately half of the surface area of knitted component 130 may be comprised of monofilament areas. In some embodiments, this may allow for a see-through nature, or opaque view of a large area of knitted component 130. Although a large area of knitted component 130 may include monofilament areas, because monofilament areas are relatively narrow and set back toward the foot of a user from exterior portion 800 of welts 170, monofilament areas may be protected from abrasion.

In some embodiments, the spacing of monofilament areas and welts may be varied. For example, in some embodiments, some monofilament areas may be approximately four courses wide, while other monofilament areas may be eight courses wide. Additionally, in some embodiments, other monofilament areas may be of varying widths. Furthermore, in some embodiments, welts 170 may be of varying widths. For example, in some embodiments, some welts may be four courses wide, while other welts may be eight courses in width. Additionally, the width of individual welts may be varied throughout knitted component 130. The combination of different widths of welts 170 and different widths of monofilament areas may provide for varied spacing of monofilament areas. Due to the welts being located between monofilament areas, the welts may impact the spacing of monofilament areas.

In some embodiments, the height of welts may additionally provide protection to monofilament areas. The height 812 of welt 700 may be defined as the distance between exterior portion 800 and exterior surface 802 of monofilament areas. In some embodiments, welts 170 may have additional courses in exterior portion 800 and fewer courses in interior portion 802. Because exterior portion 800 and interior portion 802 are attached to each other at an edge, exterior portion 800 may have a bulge or bump. In some embodiments, the bulge or bump may then extend away from interior portion 802 and monofilament area 703 and monofilament area 705. In some embodiments, the larger bump or bulge may further protect monofilament areas from abrasion. A larger bump or bulge may be formed by including more courses in exterior portion 800 and fewer courses in interior portion 802. In combination with narrow monofilament areas, a larger height of welts may limit the likelihood of an impact between an object and monofilament areas, because an impact may be absorbed by the welts.

In some embodiments, welts 170 may include an inlaid strand or tensile element. In some embodiments, the tensile element may be used as a loop 158 in the configuration of an article of footwear. Loop 158 may be configured to receive lace 154. Additionally, in conjunction with lace 154, loop 158 may assist in adjusting the fit and feel of article 100. In some embodiments, tensile elements may provide support to welts 170, which in turn may support monofilament areas. Additionally, in some embodiments, tensile elements may allow for greater support when used as a loop 158, because the tensile elements may allow for the tension from a lace 154 to extend over a portion of upper 120.

In some embodiments, monofilament areas may be formed from a translucent material. In some embodiments, monofilament areas may be substantially clear such that light may pass through monofilament areas. In addition, in some embodiments, monofilament areas may allow for the interior void of article 100 to be viewed through knitted component 130. Additionally, in some embodiments, monofilament areas may include coloring. In some embodiments, monofilament areas may be tinted to a certain hue. For example, in some embodiments, monofilament areas may be tinted a black or grey color. In other embodiments, monofilament areas may be tinted another color. In still further embodiments, monofilament areas may be a solid opaque color. That is, in some embodiments, monofilament areas may not permit light to pass from exterior surface 121 to interior surface 122 of a monofilament area. Therefore, the transparency of monofilament areas may be impacted by the transparency or lack thereof of a monofilament strand forming the respective monofilament area.

In some embodiments, transparency of monofilament areas may be impacted by the diameter of monofilament strands. In some embodiments, a single monofilament strand may have a diameter of approximately 0.114 mm that may be used to form monofilament areas. In some embodiments, a single monofilament strand may have a diameter of approximately 0.125 mm that may be used to form monofilament areas. In other embodiments, a single monofilament strand may have a diameter of approximately 0.08 mm. In other embodiments, larger diameter monofilament strands may be used to form monofilament areas. A larger diameter monofilament strand may inhibit the passing of light through the monofilament strand. Additionally, various stitch densities may be utilized in the formation of a monofilament area. In some embodiments, a high density configuration may inhibit light from passing through exterior surface 121 to the interior void formed by knitted component 130.

In some embodiments, monofilament areas within monofilament groups may be oriented in a particular direction. For example, in some embodiments, monofilament areas may be oriented in a largely vertical manner. That is, in some embodiments, monofilament areas may extend from sole structure 110 toward instep area 150. In some embodiments, monofilament areas may extend in a diagonal manner. That is, in some embodiments, monofilament areas may be oriented such that monofilament areas do not extend in a directly vertical manner. Further, in some embodiments, monofilament areas may extend along the longitudinal direction. Additionally, in some embodiments, monofilament areas may be parallel to one another. In other embodiments, monofilament areas may be oriented independently from one another.

In some embodiments, monofilament areas may be of a substantially elongated shape. Referring to FIGS. 7 and 8, monofilament areas of lateral monofilament group 164 may have substantially trapezoidal-shaped monofilament areas. For example, monofilament area 705, may be elongated and have a point near instep area 150. As shown, the shape of monofilament area 705 may be defined by welt 702 on an end located closer to heel region 14, and by welt 700 on an end located close to forefoot region 20. Additionally, the shape of monofilament area 705 may further be defined by instep border portion 186. Instep border portion 186 may be an area of upper 120 that surrounds instep area 150. In some embodiments, instep border portion 186 may include lace apertures and in other embodiments instep border portion 186 may be adjacent to loops 158. The shape of monofilament area 705 may additionally be defined by sole border portion 187. In some embodiments, sole border portion 187 may be located adjacent to sole structure 110. Additionally, in some embodiments, a portion of sole border portion 187 may be covered by sole structure 110 for aesthetic or other purposes. In some embodiments, sole border portion 187 may extend under a foot of a user and attach to a central portion of sole structure 110. The shape of monofilament area 705 is therefore defined by welt 702, welt 700, instep border portion 186 and sole border portion 187. Therefore, as the shape and orientation of welt 702, welt 700, instep border portion 186 and sole border portion 187 change, so too may the shape of monofilament area 705. As such, many different shaped monofilament areas are possible including triangular shaped, rectangular shaped, oval, circular or irregularly shaped monofilament areas. It should be recognized that monofilament area 705 may occupy the space enveloped by welt 702, welt 700, instep border portion 186, and sole border portion 187.

In some embodiments, welts that surround monofilament areas may include a tensile element which at least partially extends through the welts. For example, as shown in FIGS. 7 and 8, welt 700 includes a tensile element extending through welt 700. Additionally, other monofilament areas may be surrounded by welts that do not include tensile elements extending through the welts, as for example welt 702. Additionally, in some embodiments, the tensile element may exit and enter a particular welt multiple times. That is, the tensile element may be exposed along various portions of a welt.

In some embodiments, multifilament areas between and surrounding monofilament areas may be constructed similarly to welts as discussed above. That is, in some embodiments the multifilament areas may include an interior portion and an exterior portion. In some embodiments the exterior portion may extend beyond monofilament areas in a vertical direction. In other embodiments, multifilament areas may be constructed along the same plane as monofilament areas.

In some embodiments, monofilament areas may be oriented in a horizontal or lateral direction. In other embodiments, monofilament areas may be oriented in a vertical direction. In still further embodiments, monofilament areas may be oriented in other directions.

In some embodiments, multifilament areas between and surrounding monofilament areas may be constructed similarly to welts as discussed above. That is, in some embodiments the multifilament areas may include an interior portion and an exterior portion. For example, in some embodiments welt 702 may be of similar construction as to welt 700. In some embodiments, welts may include a tensile element extending through welts, for example welt 700. In other embodiments, the welts may be hollow or unfilled, for example welt 702. In other embodiments, however, the area occupied by welt 702 may be constructed along the same plane as monofilament area 705. For example, in some embodiments, there may not exist an exterior portion as shown in FIG. 8. The lack of an exterior portion may result in a uniform continuous surface between a monofilament area and an area formed with multifilament yarn.

Referring to FIG. 8, a cross-section of welt 700 is shown. As discussed above welts are generally hollow structures formed by two overlapping and at least partially coextensive layers of knitted material. Although the sides or edges of one layer of the knitted material forming welts may be secured to the other layer, a central area is generally unsecured such that another element may be located between the two layers of knitted material and extend through welts. As shown in FIG. 8, welt 700 may be divided into two smaller welts, welt 820 and welt 822 as discussed below. Another example of knitted components for footwear uppers that have overlapping or at least partially coextensive layers may be found in U.S. Patent Application Publication 2008/0110048 to Dua et al., which is incorporated herein by reference.

In some embodiments welts 170 extend upward along lateral side 16 and medial side 18. In some embodiments, each welt includes a tensile element that extends through the welts. In some embodiments the tensile element may extend between one welt and another. In other embodiments, the tensile element may extend along the length of a welt twice through a single welt. For example, referring to welt 700, a tensile element extends outward from an upper end of welt 700 and forms a loop 158 on the exterior of upper 120 and extends back through welt 700. As such, two tensile element sections may be partially enclosed by welt 700. In particular, tensile element 804 passes through welt 820, and tensile element 806 passes through welt 822. Although the tensile element may be a single continuous piece, each section is labeled as tensile element 804 and tensile element 806 for ease of reference. Tensile element 804 and tensile element 806 may connect to form loop 158. Welt 700 may be defined by exterior portion 800, exterior portion 801 and interior portion 802. Welt 820 may be defined by exterior portion 801, intermediate portion 830 as well as interior portion 810. Welt 822 may be defined by by exterior portion 800, intermediate portion 930 as well as interior portion 810.

In still further embodiments, some welts may not include tensile elements extending through welts. That is, in some embodiments, some welts may be tubular, however, tensile elements may not be present within the hollow structure. For example, welt 702 as shown in FIG. 7 may not include a tensile element that extends through welt 702. In further embodiments, welt 702 may be composed of a single multifilament layer. That is, in some embodiments, welt 702 may be formed along a similar plane as monofilament area 704 and monofilament area 705.

In some embodiments, welts 170 may be constructed of natural or synthetic twisted fiber multifilament yarn 810. In some embodiments, the yarn of welts 170 may be void of monofilament strand 808 that is used to form monofilament area 703, monofilament area 705, and other monofilament areas. In some embodiments, tensile element 804 and tensile element 806 may extend through welt 700 without contacting monofilament strand 808 that is used to construct monofilament area 703 and monofilament area 705. That is, in some embodiments, tensile element 804 and tensile element 806 may be set apart from monofilament strand 808. As shown in FIG. 8, tensile element 804 contacts interior portion 802, exterior portion 800 and intermediate portion 830 which are constructed completely of multifilament yarn 810 that is represented by a solid sinusoidal line. Tensile element 806 contacts interior portion 802, exterior portion 801 and intermediate portion 830. Additionally, monofilament strand 808, represented by a dashed sinusoidal line, is not present in interior portion 802, intermediate portion 830, exterior portion 800 or exterior portion 801. As such, tensile element 804 and tensile element 806 may not come into contact with monofilament strand 808 within welt 700. Therefore, as tensile element 804 or tensile element 806 is tightened or moved, tensile element 804 or tensile element 806 may contact multifilament yarn 810, thereby reducing the amount of wear that monofilament strands may experience.

Referring to FIG. 9, an exemplary looping diagram 900 depicting a portion of knitted component 130 is shown. In this embodiment, looping diagram 900 illustrates the sequence of stitches and movements performed by a knitting machine, for example, a flat-knitting machine, to form a portion of monofilament area 705 and welt 700. As shown in FIG. 9, the spaced apart dots represent the needles of a knitting machine and the illustrated steps represent the direction of movement of yarn or strand between the needles of each of a front bed and a back bed of a knitting machine. Needles located on the front bed may be referred to as "front needles" while needles located in the back bed may be referred to as "back needles." Additionally, "pass" may be used to refer to the operation of a feeder of a knitting machine moving across needle beds so that a strand or yarn interacts with and/or is manipulated by the needles of a needle bed. "Course" may refer to yarn or strand after the yarn or strand has interlooped with another yarn or strand. In many embodiments, a pass across a needle bed may be associated with a course of interlooped strands or yarns. In some embodiments, however, multiple passes may be used to form one course of a knit material. A method of manufacturing utilizing a knitting machine with a combination feeder is disclosed in previously referenced U.S. Patent Application Publication 2012/0233882 to Huffa, et al., the disclosure of which is entirely incorporated herein by reference.

As shown in FIG. 9, monofilament strand 808 may be used to knit a portion of a monofilament area 705. The looping diagram is not meant to be a specific layout or orientation of strands, but as an exemplary diagram. As shown, a first pass forms monofilament element 902 on alternating needles on the front bed and back bed of a knitting machine. That is, the first pass may form portions of two courses, one on each of the front needles and the back needles. Monofilament element 904 is also formed on alternating needles on the front bed and back bed and similarly portions of two courses, one on each of the front needles and the back needles, during a single pass. Additionally, monofilament element 906 and monofilament element 908 are formed in a similar manner. As shown, each of the monofilament courses of the elements skips a needle position between each loop on the front needle bed and the back needle bed. The configuration may allow for increased strength and stability in the monofilament area. Additionally, each monofilament course may not interloop with the adjacent course. For example, the loops on the front needle bed of monofilament element 902 align with an open needle in the corresponding position of monofilament element 904. The loops of monofilament element 902 on the front needle bed may interact, however, with the courses of monofilament element 906 on the front bed. A similar interaction between the courses of monofilament element 908 and monofilament element 904 may occur. Additionally, a similar interaction may occur between loops located on the back needles.

Multifilament element 910 is knit using multifilament yarn 810 on back needles and front needles creating two courses in one pass. In contrast to the monofilament elements, the courses of multifilament element 910 do not skip needles on the front bed or the back bed. As such, the front needle bed portion of multifilament element 910 interacts and interloops with the front bed needle portion of monofilament element 908 and monofilament element 906. Likewise, the back needle bed portion of multifilament element 910 interacts and interloops with the back bed needle portion of monofilament element 908 and monofilament element 906. In some embodiments, the back needle portion of multifilament element 910 may be considered the beginning of interior portion 802 of welt 700. The front bed needle portion of multifilament element 910 may be considered the beginning of exterior portion 801 of welt 700. Multifilament element 912 is formed on the back needle bed, creating a single course during a single pass, and interloops with the back needle portion of multifilament element 910. In some embodiments, multiple multifilament elements may be formed on the back needle bed after the formation of multifilament element 912. Additional passes by the feeder on the back needle bed may be made to form similar additional courses in order to adjust the shape and size of interior portion 802 of welt 700. For example, an embodiment which includes four additional courses on the back needle bed after multifilament course 912 may produce a larger interior portion than interior portion 802 in FIG. 8.

In some embodiments, a tensile element may be placed within the partially completed welt 700. Tensile element 804 may be inlaid between the back bed and the front bed. In some embodiments, multifilament element 914 may be formed during one pass of the feeder using a multifilament yarn interacting with needles on the front bed and the back bed. Multifilament element 914 and multifilament element 916 may skip alternating needles as discussed in reference to the monofilament elements, above. Similarly to the monofilament elements, multifilament element 914 and multifilament element 916 may interact with corresponding loops on front needle beds and back needle bed. For example, the back needle bed portion of multifilament element 914 and multifilament element 916 may interact with monofilament element 912. In some embodiments, the front bed portions of multifilament element 914 and multifilament element 916 may be considered a portion of intermediate portion 830. In some embodiments, a second tensile element 806 may be inlaid between the front bed and the back bed.

In some embodiments, tensile element 804 may contact multifilament element 912 and tensile element 806 may contact multifilament element 914. In some embodiments, a feeder may make an additional pass to knit a multifilament course 918 on the front bed. In some embodiments additional courses may be formed on the front bed that interact and interloop with multifilament course 918. By increasing the number of courses formed on the front bed after multifilament course 918, the size of exterior portion 800 may increase. Additionally, by increasing the number of courses formed on the front bed after multifilament element 910 the size of exterior portion 801 may increase.

In some embodiments, the course remaining on the front bed (in this case multifilament course 918) may be transferred to the back bed after the preferred number of courses are formed on the back bed and the front bed. After such an action, the final course on the front bed may interact and interloop with the course on the back bed. This action may complete the formation of a welt such as welt 700. Welt 700 may therefore surround a substantial portion of tensile element 804 and tensile element 806.

Further Knitted Component Configurations

Referring to FIGS. 10-14, various embodiments of an article incorporating monofilament areas are depicted. Referring in particular to FIG. 10, an embodiment of article 1004 is shown with large monofilament areas. In this embodiment, monofilament area 1000 and monofilament area 1002 are relatively large with respect to the surface area of the lateral side 16. Additionally, in comparison to the embodiment of FIG. 1, the embodiment in FIG. 10 depicts larger monofilament areas.

In some embodiments, multifilament area 1006 may surround monofilament area 1000 and monofilament area 1002. In some embodiments, multifilament area 1006 may include welts as described above. In some embodiments, welts may be similar in shape to tensile elements. For example, welt 1008 may be similar in shape to tensile element 1010.

In some embodiments, the multifilament portion adjacent to the monofilament areas may be similarly aligned to the plane in which the multifilament area 1006 is located. For example, the multifilament area between welt 1008 and monofilament area 1002 may extend along a similarly aligned plane of monofilament area 1002. Other portions of the monofilament areas of article 1004 may be bordered by multifilament area 1006 extends along a different plane.

Referring to FIG. 11, an embodiment of article 1108 that incorporates a knitted component includes multiple smaller monofilament areas of triangular shape. As shown in FIG. 11, the monofilament areas of article 1108 may be largely formed in the same manner as discussed with reference to the embodiment shown in FIG. 1. In the embodiment shown in FIG. 11, monofilament area 1104 and monofilament area 1102 may be located adjacent to welt 1106. Welt 1106 may be formed from multifilament yarns as discussed with reference to previous welt configurations.

In some embodiments, multifilament yarn 1100 may surround or border monofilament areas of article 1108. In some embodiments, the monofilament areas may be bordered by welts. In other embodiments, some monofilament areas may be bordered by multifilament yarn that is oriented along a similarly aligned plane as the monofilament areas. That is, in some embodiments, there may be a relatively even transition between monofilament areas and multifilament areas. For example, there may not be a bump or bulge formed by the multifilament areas, as in previously-discussed embodiments.

Referring to FIG. 12, an embodiment of article 1212 includes multiple monofilament areas. In this embodiment, each monofilament area may be partially bounded by a welt and with a tensile element at least partially enclosed within the welt. As shown, the shape of monofilament area 1200, monofilament area 1202, monofilament area 1204, and monofilament area 1206 are each defined in part by a welt and a tensile element located toward forefoot region 20 and toward heel region 14. In particular, monofilament area 1202 is defined by welt 1208 and welt 1210. Each of the welts includes a tensile element as discussed in previous embodiments.

In some embodiments, tensile element 1214 may be a continuous strand that extends between each welt. In other embodiments, multiple tensile elements may be utilized within each welt. In still further embodiments, some welts may not include a tensile element.

As shown, the bases of the monofilament areas are located adjacent to instep border portion 186. In other embodiments, the bases of the monofilament areas may be located adjacent to sole border portion 187. In such embodiments, the monofilament areas may also be at least partially defined by welts. In still further embodiments, the monofilament areas may be arranged in different orientations.

Referring to FIGS. 13 and 14 an embodiment of article 1306 is depicted. As in previous embodiments, monofilament areas are at least partially defined by welts. In this embodiment, monofilament areas are also shaped in a largely triangular fashion. In some embodiments, monofilament areas may be oriented in various directions. For example monofilament area 1300 is largely a triangular shape. Monofilament area 1300 extends such that the base of the triangle is located adjacent sole structure 110 of article 1306. Conversely, monofilament area 1302 is oriented such that the base of the triangle is located adjacent instep border portion 186. Additionally, monofilament area 1304 and monofilament area 1300 are oriented largely in the same manner. As such the monofilament areas of this embodiment align with one another.

In some embodiments, tensile element 1308 may act as a division between monofilament areas. For example, in the embodiment shown, tensile element 1308 is largely V-shaped in alternate directions. Monofilament area 1300 is partially bound by an upside-down V-shaped portion of tensile element 1308. That is, the base portion of monofilament area 1300 is located adjacent to sole structure 100. In contrast, monofilament area 1302 is partially bound by an upright V-shaped portion of tensile element 1308. As such, monofilament area 1302 is oriented in the opposite direction than the direction that monofilament area 1300 is oriented.

Additionally, tensile element 1308 separates the monofilament areas into sections. In some embodiments, the sections may be oriented in a similar manner. For example, all of the monofilament areas located above tensile element 1308 (that is, located toward instep border portion 186), are oriented in a similar manner. Likewise, the monofilament areas located below tensile element 1308 (that is, located toward sole structure 110) are oriented in a similar manner to one another. Furthermore, the two sections are oriented in opposite directions. Although article 1306 depicts similarly-shaped monofilament areas, it should be recognized that variously-shaped monofilament areas may be utilized in conjunction with a tensile element oriented in a different manner.

In some embodiments, the layout of and path of tensile element 1308 may allow for a large portion of article 1306 to include monofilament areas. For example, referring to welt 1303, a portion adjacent to welt 1303 toward forefoot region 10 is bordered by monofilament area 1304. Additionally, a portion adjacent to welt 1303 toward heel region 14 is bordered by monofilament area 1302. Monofilament area 1304 and monofilament area 1302 are oriented in opposite directions but may both be adjacent to a single welt. This orientation and layout may allow for a greater area of article 1306 to be encompassed by monofilament areas while maintaining the integrity and structure support that tensile element 1308 may provide.

In some embodiments, welts that separate monofilament areas may include tensile elements. For example welt 1301 and welt 1303 may include tensile elements. In some embodiments the tensile element that extends through welt 1301 and welt 1303 may be the same tensile element, for example tensile element 1308. Therefore in this embodiment, tensile element 1308 may extend through welts surrounding each monofilament area. In addition, each monofilament area is at least partially border or shaped by a welt.

Referring to FIG. 14, a cross-section of a portion of the embodiment of article 1306 shown in FIG. 13 is depicted. As shown, welt 1301 and welt 1303 are located adjacent to multiple monofilament areas. As discussed above, welts are generally hollow structures formed by two overlapping and at least partially coextensive layers of knit material. Although the sides or edges of one layer of the knitted material forming the welts may be secured to the other layer, a central area is generally unsecured such that another element may be located between the two layers of knitted material and extendss through the welts.

In some embodiments, welt 1301 includes tensile element 1408, a portion of tensile element 1308 that extends through welt 1301. Tensile element 1408 may extend through welt 1301 and enter welt 1303. For convenience, the tensile element that enters into welt 1303 it may be referred to as tensile element 1401, which is another portion of tensile element 1308. In some embodiments, tensile element 1308 may extend into other welts that are located within the article of footwear. In other embodiments, some welts may be hollow as discussed above.

As shown, welt 1301 may include an exterior portion 1400 as well as an interior portion 1402. Likewise, welt 1303 may include an exterior portion 1404 and an interior portion 1406. As discussed with regard to previous embodiments, portions of welt 1301 and welt 1303 may be composed substantially entirely of multifilament yarn 810. Additionally, monofilament areas may be composed substantially entirely of monofilament strand 808. As discussed with relation to other embodiments discussed previously, however, tensile element 1408 and tensile element 1410 may largely contact multifilament yarn 810. That is, tensile element 1408 and tensile element 1410 may be substantially separated from monofilament strand 808 which are used to form monofilament areas. As such, as tensile element 1408 and tensile element 1410 translate or move within welts, tensile element 1408 and tensile element 1410 may contact multifilament yarn 810 without contacting monofilament strand 808, thereby reducing abrasion and wear of monofilament strands.

While various embodiments have been described, the description is intended to be exemplary, rather than limiting and it will be apparent to those of ordinary skill in the art that many more embodiments and implementations are possible that are within the scope of the embodiments. Accordingly, the embodiments are not to be restricted except in light of the attached claims and their equivalents. Also, various modifications and changes may be made within the scope of the attached claims.

What is claimed is:

1. An article of footwear comprising:

a knitted component including at least one monofilament area comprised of a monofilament strand, the at least one monofilament area having a shape;

a first multifilament area adjacent to the at least one monofilament area, the first multifilament area comprising at least two overlapping knit layers of multifilament yarn, wherein the at least two overlapping knit layers form a first unsecured area there between;

a second multifilament area adjacent to the at least one monofilament area;

wherein the first multifilament area and the second multifilament area define at least a portion of the shape of the at least one monofilament area; and a first tensile element extending through at least a portion of the first unsecured area.

2. The article according to claim 1, wherein the at least one monofilament area comprises a width and wherein the width of the at least one monofilament area is at least two courses.

3. The article according to claim 1, wherein the first multifilament area includes an interior layer and an exterior layer, and wherein the interior layer and the exterior layer are at least partially connected to each other to form the first unsecured area.

4. The article according to claim 3, wherein the interior layer and the exterior layer contact the first tensile element.

5. The article according to claim 3, wherein the exterior layer includes a first number of courses and the interior layer includes a second number of courses, the first number of courses being greater than the second number of courses.

6. The article according to claim 3, wherein the at least one monofilament area is located in a first plane and the exterior layer of the first multifilament area is located in a second plane, the first plane being located closer to a foot.

7. The article according to claim 1, wherein the at least one monofilament area defines a width, the first multifilament area defines a width, and wherein the width of the at least one monofilament area is less than the width of the first multifilament area.

8. The article according to claim 1, wherein the first tensile element forms a lace loop.

9. The article of claim 1 wherein the second multifilament area comprises at least two overlapping knit layers of multifilament yarn, wherein the at least two overlapping knit layers form a second unsecured area there between.

10. The article according to claim 9, wherein the first tensile element extends from the first unsecured area into the second unsecured area.

11. The article of claim 9 wherein a second tensile element extends through at least a portion of the second unsecured area.

12. The article of claim 1 further comprising an instep border portion and a sole border portion and wherein the instep border portion and the sole border portion further define at least a portion of the shape of the at least one monofilament area.

13. The article according to claim 1 wherein the first unsecured area comprises a tubular structure through which the first tensile element extends.

14. The article according to claim 3 wherein the interior layer and the exterior layer of the first unsecured area provide a barrier between the first tensile element and the at least one monofilament area.

15. The article according to claim 1 wherein the first multifilament area is disposed on at least a portion of an outer surface of the at least one monofilament area.

16. The article according to claim 9, wherein the first tensile element extends along a length the first unsecured area two times.

17. An article of footwear comprising:

a knitted component comprising a plurality of monofilament areas comprising a monofilament strand, the plurality of monofilament areas comprising a shape;

a plurality of multi filament areas comprising at least two overlapping knit layers of multifilament yarn, wherein the at least two overlapping knit layers comprise an interior layer and an exterior layer and wherein the plurality of multifilament areas define at least a portion of the shape of the plurality of monofilament areas;

wherein the plurality of monofilament areas are located in a first plane and wherein at least the exterior layer of the plurality of multifilament areas is located in a second plane.

18. The article of claim 16 wherein the second plane is located radially outwardly of the first plane.

* * * * *